US005894318A

United States Patent [19]

Endo

[11] Patent Number: 5,894,318

[45] Date of Patent: Apr. 13, 1999

[54] IMAGE FORMING DEVICE HAVING LAMINATING FUNCTION

[75] Inventor: Yoshinori Endo, Toyota, Japan

[73] Assignee: Brother Kogyo Kabushiki Kaisha, Nagoya, Japan

[21] Appl. No.: 08/874,473

[22] Filed: Jun. 16, 1997

[30] Foreign Application Priority Data

Jun. 27, 1996 [JP] Japan ..... 8-167553

[51] Int. Cl.[6] ..... G03G 15/20

[52] U.S. Cl. ..... 347/262; 347/116; 347/264; 399/342

[58] Field of Search ..... 347/116, 228, 347/242, 256, 264, 262; 399/66, 67, 69, 75, 320, 330, 342, 388

[56] References Cited

FOREIGN PATENT DOCUMENTS 62-201471 9/1987 Japan .

OTHER PUBLICATIONS

English language translation of JP 62-201,471.

*Primary Examiner*—N. Le
*Assistant Examiner*—Hai C. Pham
*Attorney, Agent, or Firm*—Oliff & Berridge, PLC

[57] ABSTRACT

A laser printer having a manual insertion port through which a pair of lamination sheet members interposing therebetween a printed card is insertable into a sheet feed passage. The laser printer also includes a sheet supply roller, a pair of resist rollers, an image forming unit, and a fixing unit. The pair of lamination sheet members are heat-sealed together by the heat generated at the fixing unit. An operation panel is provided for selecting one of printing mode and lamination mode. If the printing mode is selected, rotation of the resist rollers is temporarily stopped so as to abut a leading edge of the sheet with the resist roller for performing skew correction. If the lamination mode is selected, the skew correction with respect to the lamination sheet members is not performed.

21 Claims, 18 Drawing Sheets

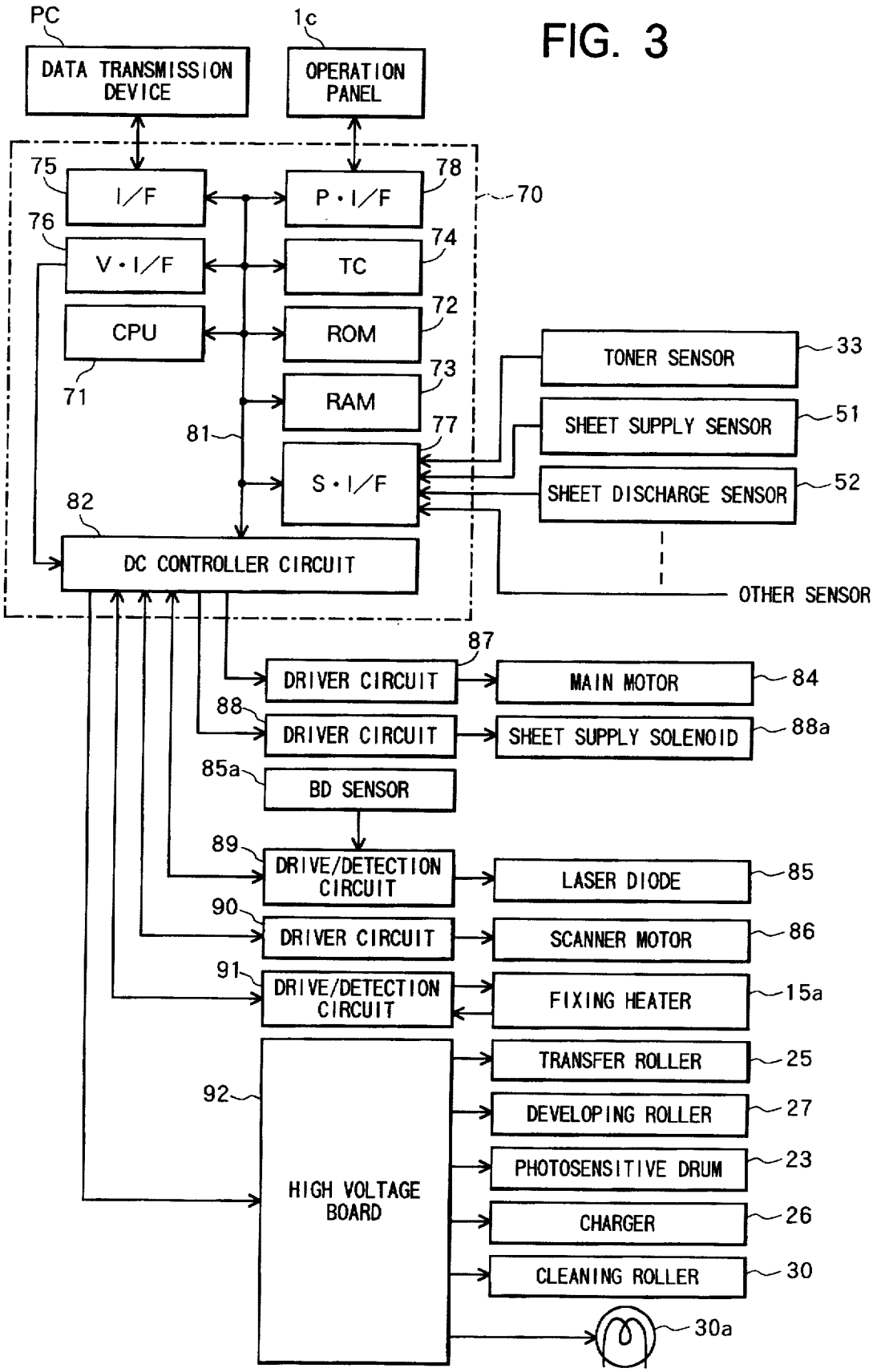
FIG. 3
PC
DATA TRANSMISSION DEVICE
1c
OPERATION PANEL
75
I/F
78
P・I/F
70
76
V・I/F
74
TC
CPU
72
ROM
71
73
RAM
81
77
S・I/F
82
DC CONTROLLER CIRCUIT
TONER SENSOR
33
SHEET SUPPLY SENSOR
51
SHEET DISCHARGE SENSOR
52
OTHER SENSOR
87
DRIVER CIRCUIT
MAIN MOTOR
84
88
DRIVER CIRCUIT
SHEET SUPPLY SOLENOID
88a
85a
BD SENSOR
89
DRIVE/DETECTION CIRCUIT
LASER DIODE
85
90
DRIVER CIRCUIT
SCANNER MOTOR
86
91
DRIVE/DETECTION CIRCUIT
FIXING HEATER
15a
92
HIGH VOLTAGE BOARD
TRANSFER ROLLER
25
DEVELOPING ROLLER
27
PHOTOSENSITIVE DRUM
23
CHARGER
26
CLEANING ROLLER
30
30a

IMAGE FORMING DEVICE HAVING LAMINATING FUNCTION

BACKGROUND OF THE INVENTION

The present invention relates to an image forming device provided with a laminating function.

In a conventional image forming device such as a laser printer, there is provided a sheet supplying portion, a developing portion, a transfer portion, and a fixing portion. A sheet supplying portion includes a sheet supply roller for supplying an uppermost sheet of a sheet stack to the developing portion. Further, a pair of resist rollers are provided for feeding the sheet supplied from the sheet supply roller to the developing portion.

In order to eliminate a formation of a diagonal image on the sheet, the orientation of the sheet is corrected by the resist rollers before the developing operation. That is, skew correction is performed. More specifically, the rotation of the resist rollers is temporarily stopped, so that a leading edge of the sheet abuts the peripheral surface of the resist rollers. By this abutment, the leading edge of the sheet can be oriented in a direction perpendicular to the sheet feeding direction.

In the developing portion, an electrostatic latent image is formed on a photosensitive drum based on an imaging information, and a toner image corresponding to the electrostatic latent image is formed on the photosensitive drum. In the transfer portion, an image recording medium such as a sheet is interposed between the photosensitive drum and a transfer member imparted with a transfer bias voltage for transferring the toner image onto the sheet. In the fixing portion, the toner image transferred onto the sheet is fixed by heating the sheet. A sheet feed passage is provided passing successively through the transfer portion and the fixing portion.

In an electrophotographic type image forming device such as the laser printer and a facsimile machine those performing high speed printing, printing data such as text data and graphic data are transmitted from an external device such as a host computer or a personal computer. In the image forming device, the inputted printing data are developed into bit image data, and the developed bit image data are stored in a printing image buffer. In the developing portion, a line-base electrostatic latent image is successively formed on the photosensitive drum at every one dot line corresponding to one raster retrieved from the printing image buffer.

In a recent demand, a sheet protection such as a lamination becomes popular in such a manner that a rectangular sheet such as a sheet card or a drive license card printed with an image is sandwiched and hermetically sealed by a pair of transparent lamination sheet members whose size is slightly greater than the rectangular card. For the lamination process, a special lamination device is provided in which the pair of lamination sheet members are pressed and heat sealed at a relatively high temperature.

As described above, the laser printer provides the fixing portion where the sheet is nipped between a heat roller and a pressure roller so as to pressedly melt the toner which has been transferred onto the sheet. To this effect, the fixing portion is adapted to generate a heating temperature of about 150° C. Thus, the fixing portion of the laser printer is available for the lamination process in terms of heating and pressing the lamination sheet members.

In this regards, there has been proposed an image forming device capable of performing lamination process by allowing the lamination sheet members to pass through the sheet feed passage if image forming process is not conducted. With this arrangement, pressing force and heat those being provided by the fixing portion can be effectively utilized.

However, if the pair of lamination sheet members interposing therebetween the card are fed along the sheet feed passage, positional misalignment may occur between the upper and lower lamination sheet members, and these two lamination sheet members are fuse-bonded together with involving wrinkles. Alternatively, air may be trapped between the lamination sheet members to provide a laminated product of low quality.

SUMMARY OF THE INVENTION

The above described drawback is attributed to the skew correcting operation with respect to the lamination sheet members. That is, by the temporary abutment of the leading edge of the lamination sheet members with the non-rotating resist rollers, the lamination sheet members may be flexed or bent because the sheet supply roller fed the remaining part of the lamination sheet members in the sheet feeding direction. By the bending of the lamination sheet members, relative displacement in the sheet feeding direction between the lamination sheet members may occur, or floating of one lamination sheet members from the other may occur. Such misalignment between the upper and lower lamination sheet members may cause generation of wrinkles and air trapping as a result of laminating or heat sealing operation.

It is therefore an object of the present invention to provide an image forming device having laminating function in which desirable lamination quality can be obtained without displacement of the lamination sheet members, formation of wrinkles nor air trapping when the device is operated in the lamination mode.

This and other objects of the present invention will be attained by an image forming device for forming a visible image on an image recording medium running in a sheet feed passage, the image recording medium having a leading edge in a sheet feeding direction, the device including a skew correcting portion, an image forming portion, a fixing portion, mode setting means, and a control unit. The skew correcting portion is disposed along the sheet feed passage for aligning the leading edge with a predetermined orientation. The image forming portion is disposed along the sheet feed passage and downstream of the skew correcting portion in the sheet feeding direction for forming the visible image on the image recording medium. The fixing portion is disposed along the sheet feed passage and downstream of the image forming portion. The fixing portion heats the image recording medium for fixing the visible image on the image recording medium. The mode setting means is adapted for selectively setting one of a printing mode for printing the visible image on the image recording medium and a lamination mode for heat-sealing a pair of lamination sheet members interposing therebetween a card to produce a lamination sheet at the fixing portion. The control unit is connected to the mode setting means, the skew correcting portion, the image forming portion and the fixing portion for activating the skew correcting portion, the image forming portion and the fixing portion in response to a selection of the printing mode by the mode setting means, and for deactivating the skew correcting portion and the image forming portion while activating the fixing portion in response to a selection of the lamination mode by the mode setting means.

BRIEF DESCRIPTION OF THE DRAWINGS

In the drawings:

FIG. 3 is a block diagram showing a control unit and various components connected thereto according to the embodiment of this invention;

FIG. 9(*b*) is a cross-sectional view showing the lamination sheet members and the paper card;

FIG. 15(*b*) is a view showing a posture of a second lever before sheet supplying operation according to the embodiment of this invention;

FIG. 19(*b*) is a view showing feeding fashion of an image recording sheet in the printing mode according to the embodiment.

DETAILED DESCRIPTION OF THE PREFERRED EMBODIMENTS

Figure 1:
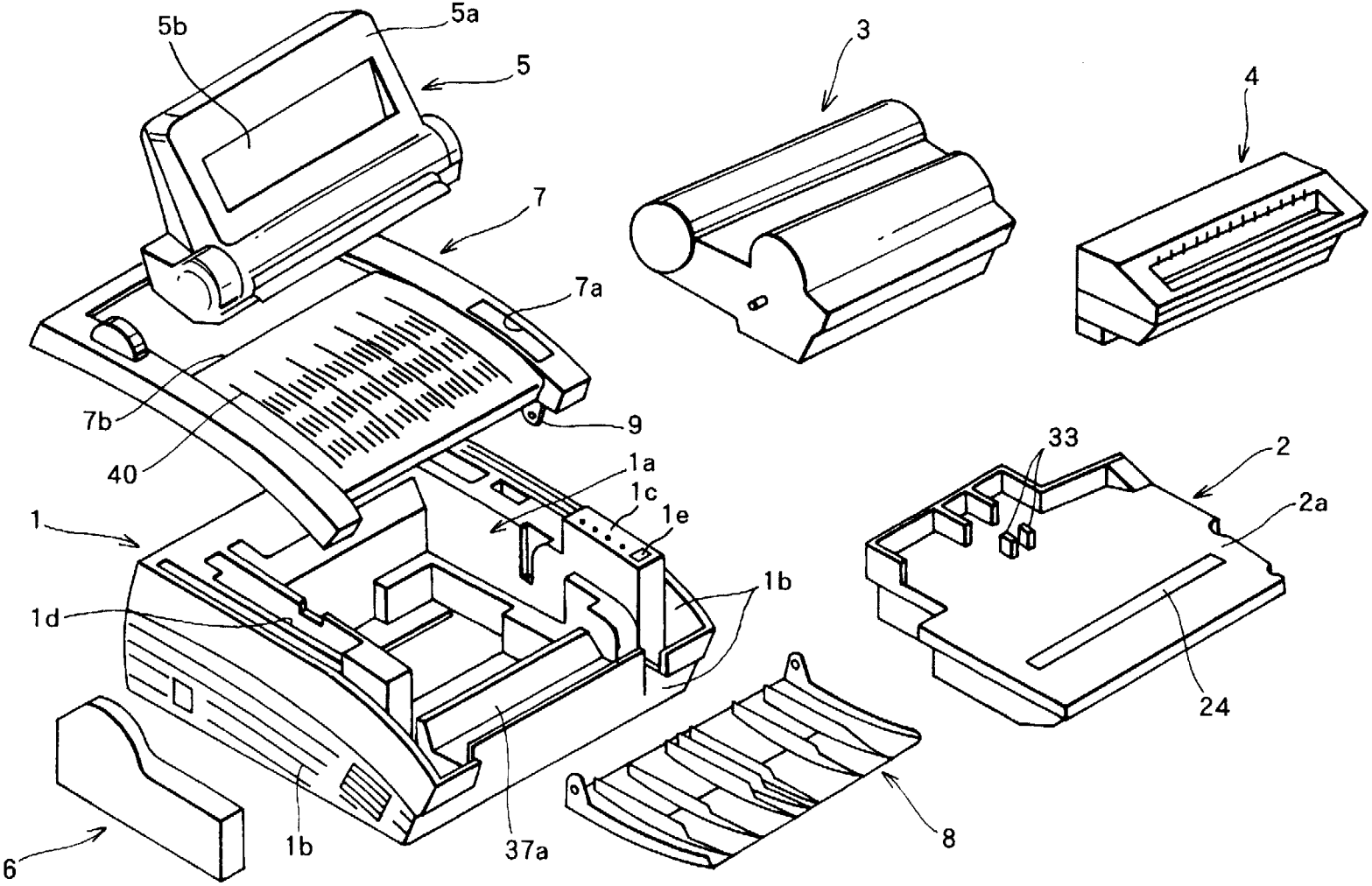
FIG. 1 is an exploded perspective view showing various parts and units of a laser printer according to one embodiment of the present invention.

An image forming device according to one embodiment of the present invention will be described with reference to the accompanying drawings. The illustrated embodiment pertains to a laser printer, which includes a main body 1 made of synthetic resin and having a main frame 1*a* and a main cover 1*b* as shown in FIG. 1. The main frame 1*a* has a box shape and has an upper open end. The main frame 1*a* accommodates therein a scanner unit 2 as an exposure unit, a process unit 3 serving as an image transfer portion, a fixing unit 4, and a sheet feed unit 5. These units can be installed in the main frame 1*a* from its upper opening. The main cover 1*b* serves to cover the four sides (front and rear sides and right and left sides) of the main frame 1*a*. The main frame 1*a* and the main cover 1*b* are integrally formed with injection molding or the like. An operation panel 1*c* protrudes upwardly from the right side of the main frame 1*a*, and a panel switch 1*e* is provided for selecting one of a printing mode and a lamination mode.

A drive system unit 6 including a drive motor and a gear train is disposed into an accommodation recess 1*d* defined in FIG. 1 between the left side inner surface of the main cover 1*b* and the left side of the main frame 1*a* adjacent thereto. The drive system unit 6 is inserted into the accommodation recess 1*d* through its lower opening.

A top cover 7 made of synthetic resin is in the form of a body cover for covering the upper open end of the main frame 1*a* and the main cover 1*b*. The top cover 7 is formed with an opening 7*a* which allows the operation panel 1*c* to extend therethrough. The top cover 7 is also formed with an opening 7*b* through which a base end of the sheet feed unit 5 extends. A plurality of air outlets 40 is formed in the top cover 7 so as to allow cooling air to discharge therethrough. Further, a base end of a discharge tray 8 is mounted pivotally up and down to a couple of brackets 9 (one of which is visible) projectingly provided on opposite ends at the front edge of the top cover 7. The arrangement is such that when the discharge tray 8 is not used, the discharge tray 8 is collapsible toward and seated on the upper surface side of the top cover 7.

The sheet feed unit 5 includes a feeder case 5*a* in which sheets P are accommodated in a stacked manner. A sheet supply roller 11 is rotatably disposed in the sheet feed unit 5, and a support plate 10 is urgedly disposed toward the sheet supply roller 11 by a biasing spring 10*a* disposed within the feeder case 5*a*. The sheet supply roller 11 is drivingly rotated by the drive system unit 6. Further, a separation pad 12 is disposed in confronting relation with the sheet supply roller 11. Thus, Leading edges of sheets P are pressed toward the sheet supply roller 11 by the support plate 10, and are separated one by one by the separation pad 12 and the sheet supply roller 11.

The thus separated sheet P is delivered to the process unit 3 by means of a pair of upper and lower resist rollers 13, 14 for forming a toner image on the surface of the sheet of paper P in the process unit 3. The image is fixed by a heat roller 15 and a pressure roller 16 of the fixing unit 4, and then the sheet P carrying the fixed image is discharged onto the discharge tray 8 by way of a sheet discharge unit including a discharge roller 17 and a pinch roller 18 which are located downstream of the heat roller 15 and the pressure roller 15 within a fixing unit case.

A manual insertion hole 5*b* which is open in an upwardly slanting manner is provided at the sheet feed unit 5. A lamination sheet or a sheet different from the sheet P of the sheet stack can be inserted into the sheet feed passage through the manual insertion hole 5*b*. A path between the manual insertion hole 5*b* and the sheet supply roller 11 serves as a manual sheet feed passage.

The process unit 3 is located in substantially the middle, when viewed in plan view, of the main frame 1*a*. At a position below the process unit 3, an upper support plate 2*a* of the scanner unit 2 is secured by means of screws (not shown) to a stay section (not shown) integrally projecting upwardly from a bottom plate of the main frame 1*a*. The upper support plate 2*a* is made of a synthetic resin, and essential components of the scanner unit 2 are disposed below the upper support plate 2*a*.

The scanner unit 2 serving as the exposure unit includes a laser emitting section, a polygon mirror 20, a lens 21, and a reflection mirror 22, etc. The upper support plate 2*a* is formed with a transversely elongated scanner aperture. The aperture extends in a direction parallel with an axial direction of a photosensitive drum 23 of the process unit 3. Further, a glass plate 24 is provided for covering the aperture. A laser beam irradiated from the laser emitting section passes through the glass plate 24 and the aperture and reaches the peripheral surface of the photosensitive drum 23 of the process unit 3 for exposing the photosensitive drum 23 to the laser beam.

Figure 2:
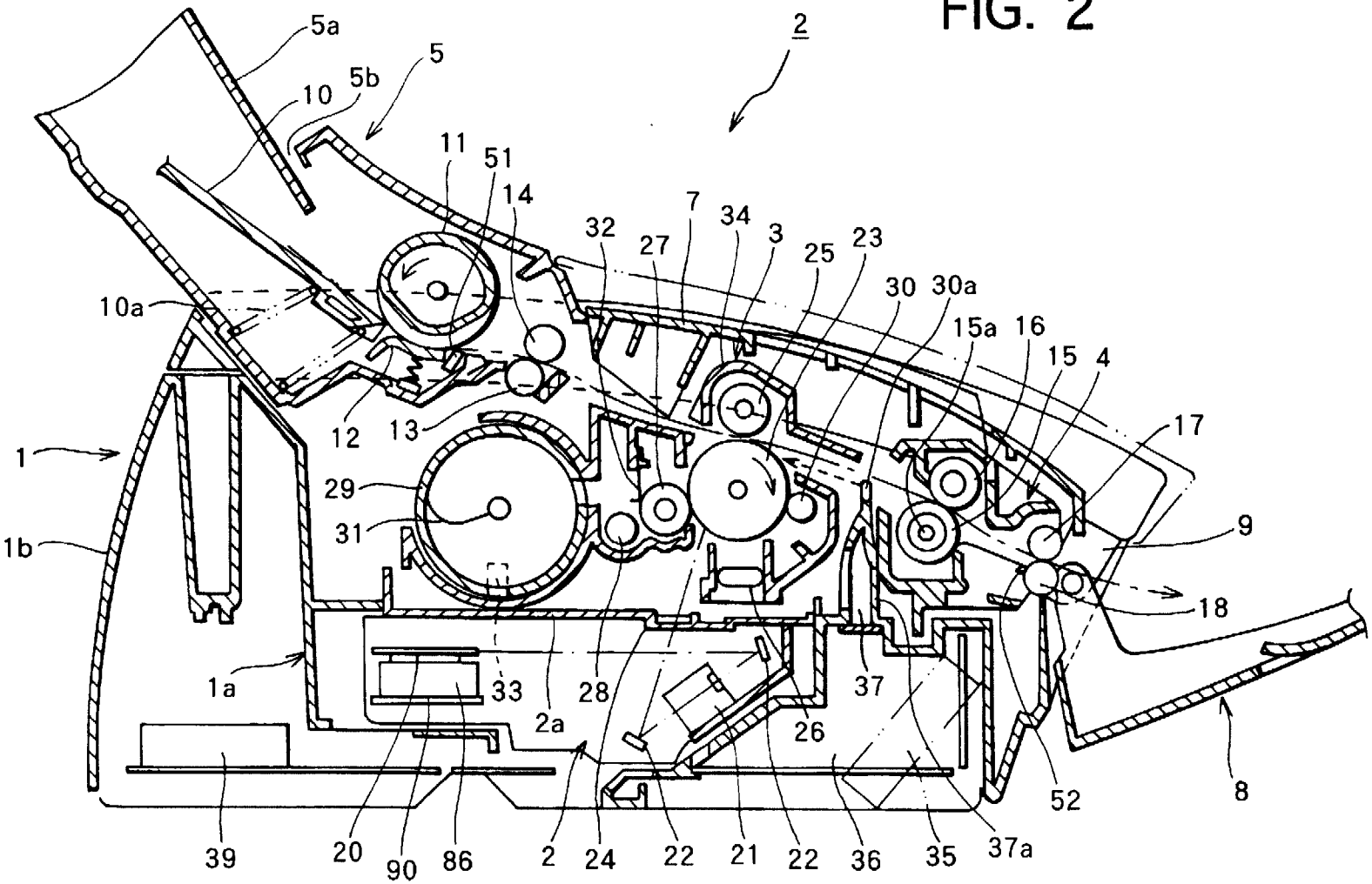
FIG. 2 is a schematic cross-sectional view showing the laser printer of FIG. 1.

As shown in FIG. 2, the process unit 3 includes the photosensitive drum 23, a transfer roller 25 positioned thereabove and in nipping relation therewith, a scorotoron charger 26 positioned below the photosensitive drum 23, a developing unit disposed upstream of the photosensitive drum 23 in the sheet feed direction and having a developing roller 27 an a toner supply roller 28, a toner cartridge 29 disposed on the upstream side of the developing unit and serving as a development agent (toner) supply section, and a cleansing roller 30 disposed downstream of the photosensitive drum 23. Further, an agitating element 31 is rotatably disposed in the toner cartridge 29 for agitating toners accumulated therein. Furthermore, a blade 32 is provided in contact with the developing roller 27. The entire process unit 3 is incorporated into a case 34 made of a synthetic resin to make a cartridge. The process unit 3 in the form of a cartridge is removably attached to the main frame 1*a*.

An electrostatic latent image is formed on the outer periphery of the photosensitive drum 23 by scanning with the scanner unit 2 while charging the peripheral surface of the photosensitive drum 23 by the charger 26. The developing agent or the toner accommodated in the toner cartridge 29 is stirred by the agitating element 31 and discharged from the toner cartridge 29. The toner is then carried on the outer periphery of the developing roller 27 by means of the toner supply roller 28. The thickness of the toner layer formed on the developing roller 27 is regulated by the blade 32. The electrostatic latent image on the photosensitive drum 23 becomes visible by the adhesion of the toner supplied from the developing roller 27. The visible toner image is then transferred onto the sheet P passing through the nip between the transfer roller 25 and the photosensitive drum 23, the transfer roller 25 being applied with a transfer bias voltage whose polarity is opposite to that applied to the photosensitive drum 23. Then, the toner remaining on the photosensitive toner 23 is temporarily collected by the cleaning roller 30 and then returned onto the photosensitive drum 23 at a predetermined timing. Then the toner on the photosensitive drum 23 is collected into the interior of the process unit 3 by means of the developing roller 27.

The upper support plate 2*a* of the scanner unit 2 is provided with an upwardly protruding toner sensor 33 consisting of a light emitting portion and a light receiving portion. Further, the toner cartridge 29 has a bottom portion formed with a recess. The toner sensor 33 is positioned within the recess for detecting the presence or absence of the toner within the toner cartridge 29.

On the bottom surface side of the junction between the front portion of the main frame 1*a* and the front portion of the main cover 1*b*, there are provided an accommodation section 36 for accommodating a cooling fan 35 and a ventilation duct 37 transversely extending in the direction orthogonal to the passing direction of the sheet of paper P. The accommodation section 36 and the ventilation duct 37 are fluidly connected to each other. The ventilation duct 37 is defined by an upper plate portion 37*a* having a V-shape in section and is formed with a plurality of slits. The upper surface portion 37*a* is positioned between the process unit 3 and the fixing unit 4 so as to prevent heat generated from the heat roller 15 in the fixing unit 4 from being directly transmitted to the process unit 3.

A cooling air generated by the cooling fan 35 passes through the interior of the ventilation duct 37 and then passes along a bottom surface of the main frame 1*a* to cool a power supply source 39 (see FIG. 2) and a drive motor (not shown) of the drive system unit 6. The power supply source 39 is positioned at the rear part of the main frame 1. Simultaneously, the cooling air ejects through the plurality of slits toward the process unit 3, and then upwardly moves through a gap between the process unit 3 and the fixing unit 4. The cooling air is then discharged through the plurality of air outlets 40 formed in the top cover 7.

Figure 9:
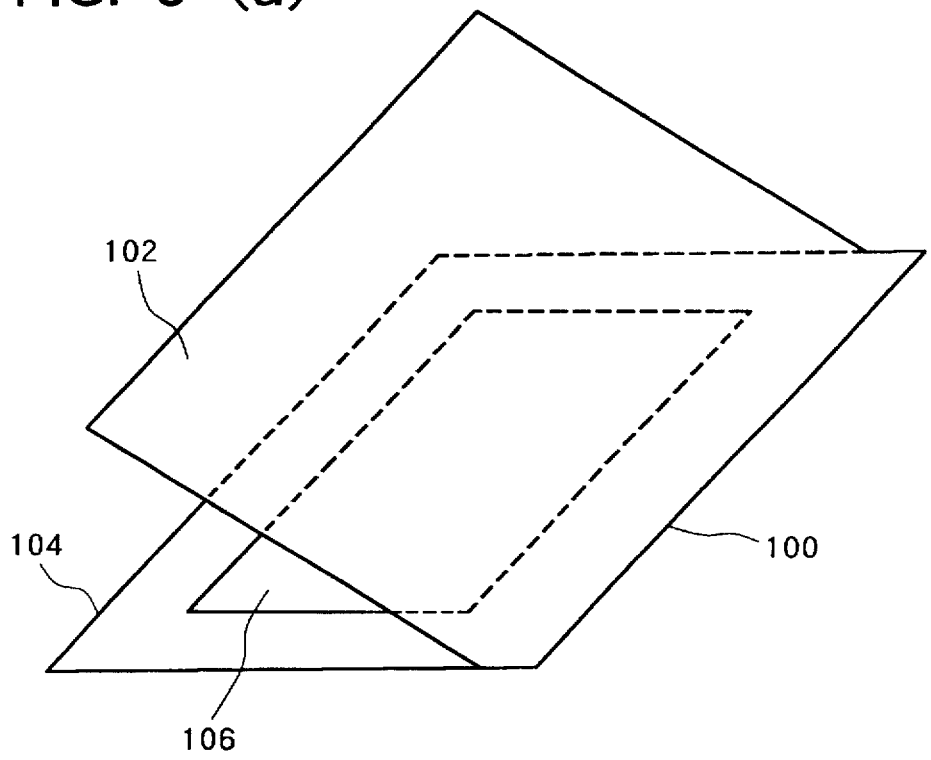
FIG. 9(*a*) is a perspective view showing lamination sheet members and a paper card to be laminated thereby.
Figure 9:
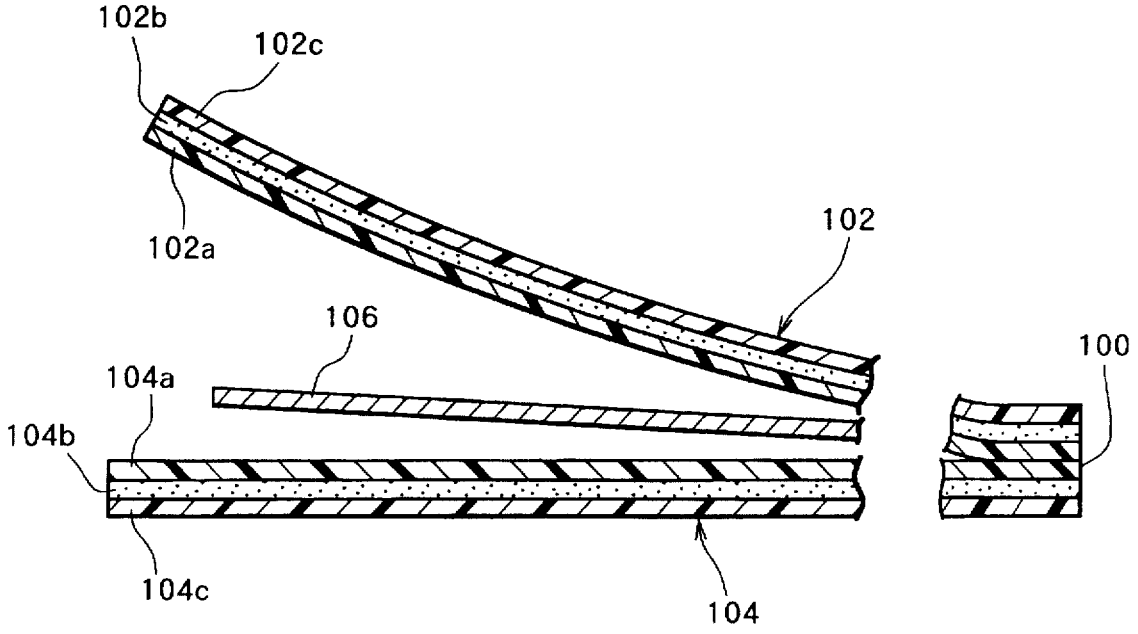

As shown in FIG. 9(*b*), the lamination sheet members 102,104 includes inner polyethylene layers 102*a*, 104*a* comfortable with each other, an outer polyethylene terephthalate layers 102*c*, 104*c* and intermediate layers 102*b*, 104*b* made of EEA (ethylene ethyl acrylate copolymer). With this arrangement, when the two lamination sheet members 102, 104 are pressurizingly heated by the heat roller 15 and the pressure roller 16, the inner polyethylene layers 102*a*, 104*a* are melted at a temperature of about 80° C. In accordance with the melt of the inner polyethylene layers 102*a*, 104*a*, the intermediate EEA layers 102*b*, 102*b* are exposed, so that the lamination sheet members 102, 104 are bonded together interposing the sheet card therebetween. Incidentally, the configuration of the lamination sheet members 102, 104 can be maintained because the external polyethylene terephthalate layers 102*c*, 104*c* have melting point greater than 150° C.

Figure 14:
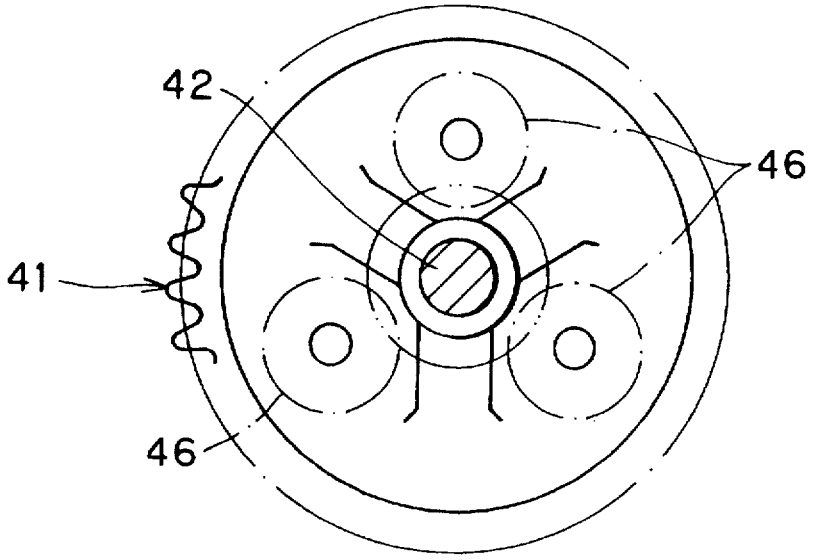
FIG. 14 is a view as viewed from an arrow XIV of FIG. 13.
Figure 15A:
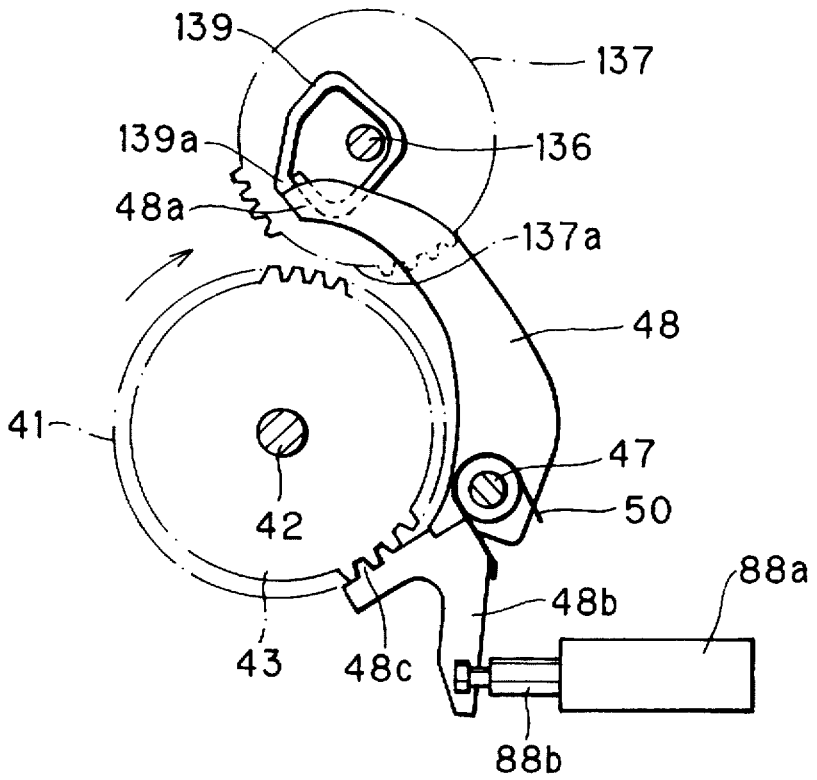
FIG. 15(*a*) is a view showing a posture of a first lever before sheet supplying operation according to the embodiment of this invention.
Figure 15B:
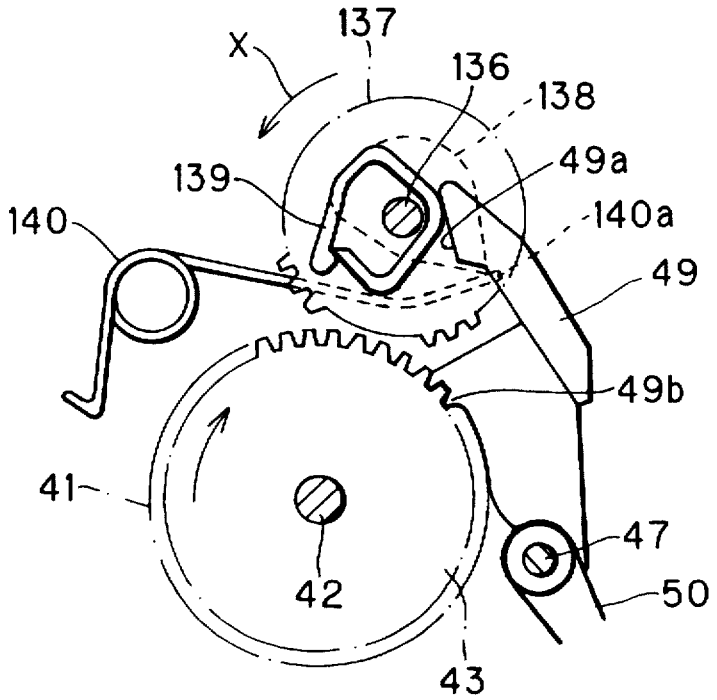

A sheet supply solenoid 88*a* (FIG. 3, FIG. 15(*a*)) is provided for driving the sheet supplying mechanism including the sheet supply roller 11. A description will be given with respect to the details of the sheet supplying mechanism and a gear transmission mechanism 135 for driving the resist rollers 13, 14 with reference to FIGS. 11 through 18.

Figure 11:
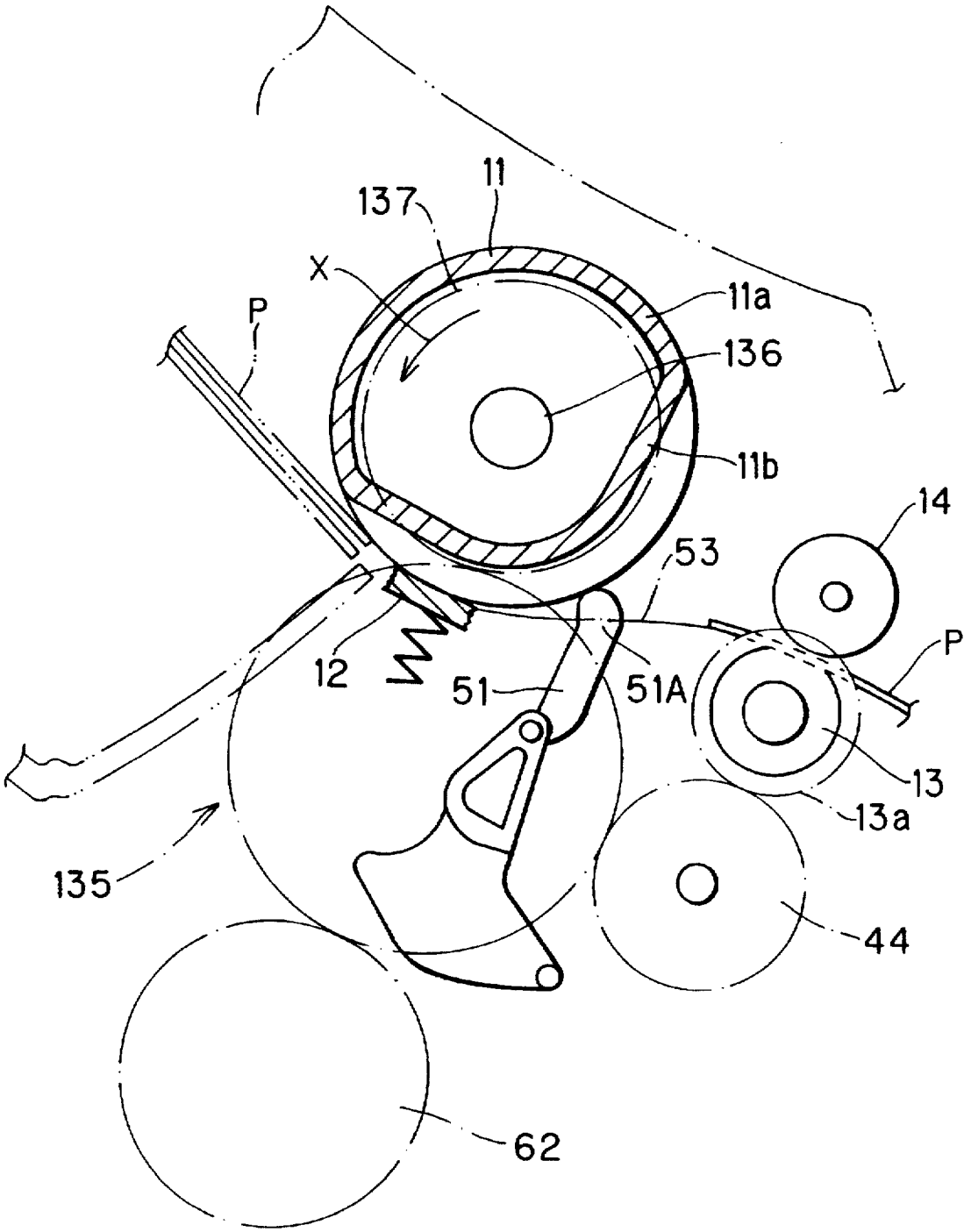
FIG. 11 is a view for description of a sheet supplying mechanism and a skew correcting mechanism according to the embodiment of this invention.
Figure 12:
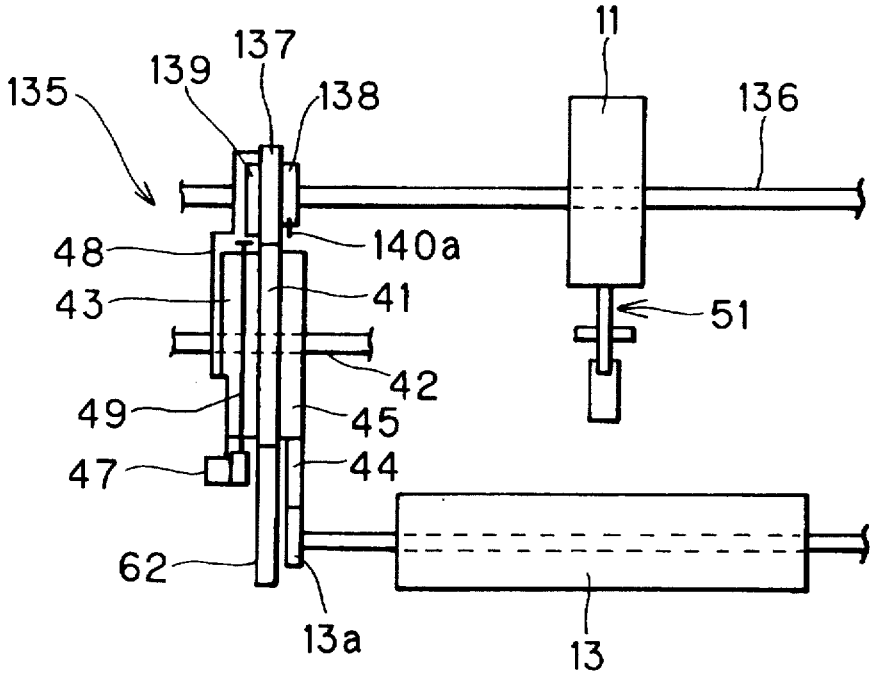
FIG. 12 is another view for description of the sheet supplying mechanism and the skew correction according to the embodiment of this invention.

As shown in FIGS. 11 and 12, the sheet supply roller 11 has a sector shape provided with a semi-circular portion 11*a* and a linear portion 11*b*. The sheet supply roller 11 is fixedly mounted on a shaft 136, and an intermittent gear wheel 137 is also fixedly mounted on the shaft 136. The intermittent gear wheel 137 has a non-teeth portion 137*a* (FIG. 15(*a*)). A sheet supply sensor 51 including a rod member 51A is disposed between the sheet supply roller 11 and the resist roller 13. The rod member 51A is pivotally movably supported so that is free end projects across a sheet feed passage 53. A photointerrupter (not shown) is provided so as to generate a sheet detection signal. When the rod member 51A is pivotally moved in the clockwise direction because of the passage of the leading end of the sheet P over the rod member 51A, a leading edge detection signal is provided. Similarly, when a trailing edge of the sheet P moves past the rod member 51A, the rod member 51A is pivotally moved in the counterclockwise direction so as to generate a trailing edge detection signal.

When the sheet P moves past the sheet supply sensor 51, the sensor 51 is pivotally moved downwardly (clockwise direction in FIG. 11) so as to detect a sheet supply. An input gear 41 is meshedly engaged with the intermittent gear 137, and a drive gear 62 is meshedly engaged with the input gear 41. Further, an intermediate gear 44 is rotatably provided, which is meshedly engaged with a gear 13*a* of the resist roller 13 for rotating the latter.

As best shown in FIG. 12, a spring receiving cam 138 is integrally provided with one side of the intermittent gear wheel 137, and a locking cam 139 is integrally provided with another side thereof. The input gear 41 is rotatably supported by a shaft 42, and a resist clutch 43 is positioned at one side of the input gear 41 and is rotatably supported on the shaft 42. Further, a transfer gear 45 is positioned at another side of the input gear 41 and is rotatably supported on the shaft 42. The transfer gear 45 is meshedly engaged with the intermediate gear 44 for rotating the same. A first lever 48 and a second lever 49 are pivotally movably supported on a shaft 47. A reference numeral 140*a* (FIG. 12) designates an end of a torsion spring, described later.

Figure 13:
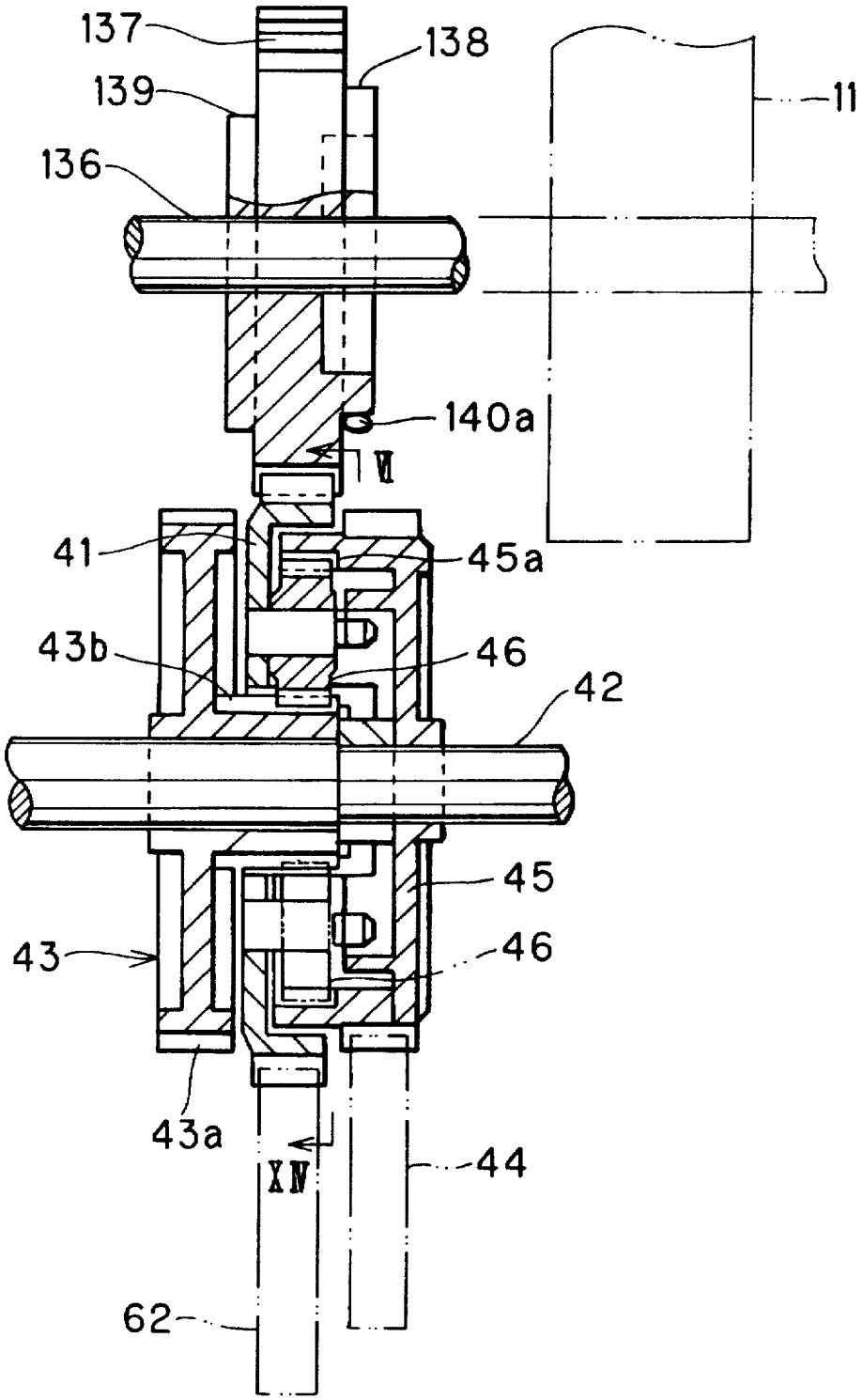
FIG. 13 is a cross-sectional view showing the sheet supplying mechanism and the skew correcting mechanism.

As shown in FIG. 13, the resist clutch 43 includes a large diameter gear portion 43*a* and a small diameter gear portion 43*b* extending through a center portion of the input gear 41. Further, the transfer gear 45 has an inner gear teeth portion 45*a*. At one side of the input gear 41, the one side confronting the transfer gear 45, a plurality of planetary gears 46 are rotatably supported (three planetary gears 46 are shown in FIG. 14). Each planetary gear 46 is meshedly engaged with the small diameter gear portion 43*b* of the resist gear 43 and the inner gear teeth portion 45*a* of the transfer gear 45.

As shown in FIGS. 15(*a*) and 15(*b*), the shaft 47 is positioned in the vicinity of the resist clutch 43, and each base end of the first and second levers 48, 49 positioned close to each other is provided pivotably about the shaft 47. The locking cam 139 has a locking portion 139*a*, and the first lever 48 has a free end provided with a cam lock portion 48*a* engageable with the locking portion 139*a*. The second lever 49 has a free end provided with an abutment portion 49*a* in pressure contact with the outer cam surface of the locking cam 139. A biasing member such as a coil spring 50 is interposed between the first and second levers 48 and 49 for urging the first lever 48 to provide locking engagement between the cam lock portion 48*a* and the locking portion 139*a* and for urging the second lever 49 to provide pressure contact of the abutment portion 49*a* with the cam surface of the locking cam 139.

A protruding part 48*b* projects from the base end of the first lever 48 in a direction opposite thereto. The protruding part 48*b* is provided with a first engagement portion 48*c* engageable with the large diameter gear portion 43*a* of the resist clutch 43. The protruding part 48*b* is connected to a plunger 88*b* of the sheet supply solenoid 88*a*.

Upon turning ON the sheet supply solenoid 88*a*, the cam locking portion 48*a* of the first lever 48 is disengaged from the locking portion 139*a* of the locking cam 139, and at the same time, the first engagement portion 48*c* is disengaged from the large diameter gear portion 43*a*. Alternatively, upon turning ON the sheet supply solenoid 88*a*, the first engagement portion 48*c* is disengaged from the large diameter gear portion 43*a*, with the cam locking portion 48*a* being in a disengaging state from the locking portion 139*a*.

Figure 17A:
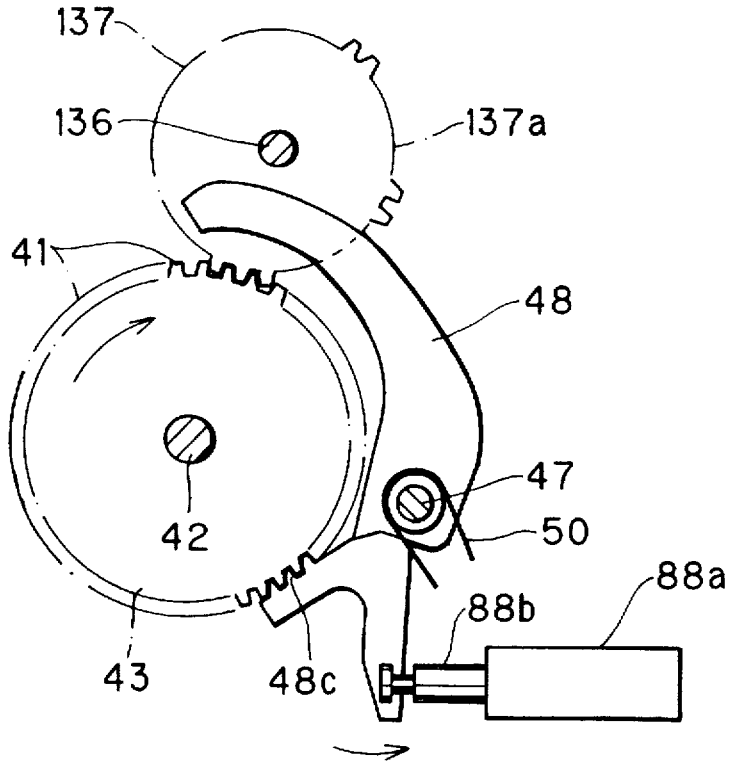
FIG. 17(*a*) and 17(*b*) are views showing postures of the first and second levers, respectively at a phase immediately before the skew correcting operation.
Figure 17B:
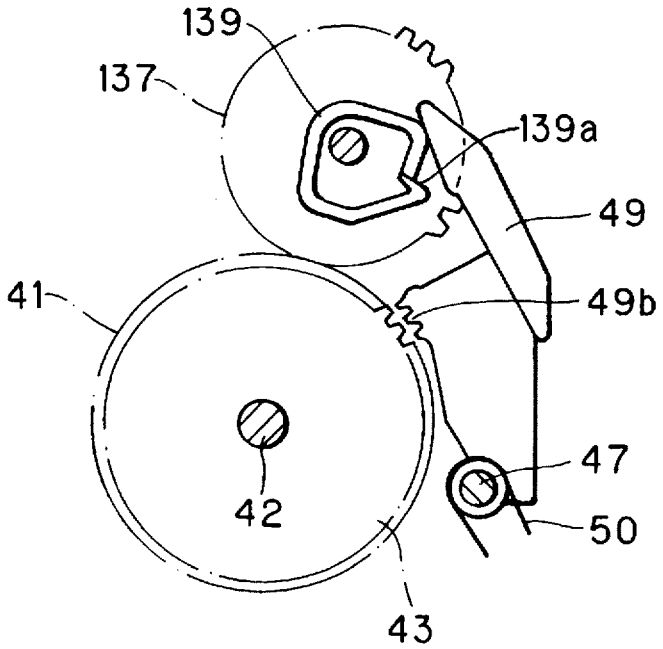

The second lever 49 has an intermediate portion provided with a second engagement portion 49*b*. The second engagement portion 49*b* is selectively engageable with the large diameter gear portion 43*a* in accordance with the pivotal movement of the second lever 49*a* about the shaft 47 based on the angular rotational phase of the locking cam 139. More specifically, the locking cam 139 has a small radius portion and a large radius portion. If the abutment portion 49*a* is in contact with the small radius portion as shown in FIG. 15(*b*), the second engagement portion 49*b* is meshedly engaged with the large diameter gear potion 43*a*. On the other hand, if the abutment portion 49*a* is in contact with the large radius portion as shown in FIG. 17(*b*), the second engagement portion 49*b* is disengaged from the large diameter gear potion 43*a*.

As shown in FIG. 15(*b*) the spring receiving cam 138 has an outer peripheral cam surface to which the one end 140*a* of the torsion spring 140 is urgedly pressed. As a result, the intermittent gear 137 is urged in a direction indicated by an arrow X, i.e., a counterclockwise direction, that is, the meshing engagement direction of the intermittent gear wheel 137 with the input gear 41 driven by the gear 62.

With this arrangement, during rotation of a main motor 84 (described later), the input gear 41 is continuously rotated. In this case, if the rotation of the resist clutch 43 is prevented by the engagement between the second engagement portion 49*b* and the large diameter gear portion 43*a*, (or by the engagement between the first engagement portion 48*c* and the large diameter gear portion 43*a*, the planetary gears 46 are rotated, so that the transfer gear 45 is rotated for drivingly rotating the resist rollers 13, 14. On the other hand, if the resist clutch 43 is at its rotatable phase, the transfer gear 45 is not rotated because of the non-rotation of the planetary gears 46 due to the concurrent rotation of the resist clutch 43 with the input gear 41. Therefore, the rotation of the resist rollers 13, 14 is stopped.

A control unit 70 is provided at a right side space defined between the main frame 1*a* and the main cover 1*b*. As best shown in FIG. 3, various components and circuits are connected to the control unit 70. The control unit 70 includes a CPU 71, a ROM 72, a RAM 73, a timing control circuit (TC) 74, an interface (I/F) 75, a video interface (V·I/F) 76, a sensor interface (S·I/F) 77, and a panel interface (P·I/F) 78 those connected to the CPU 71 by a bus 81. The ROM 72 stores therein various control programs. The RAM 73 is provided with various memories such as a data receiving buffer which stores therein data transmitted from an external data transmission device PC such as a personal computer and a host computer. The timing control circuit (TC) 74 is adapted for generating a timing signal which determines a timing for writing and reading the inputted data. The interface (I/F) 75 is adapted for receiving the transmitted printing data. The video interface (V·I/F) 76 is provided with a scan buffer and is adapted for sequentially transmitting printing information converted as bit image data to a DC controller circuit 82. The sensor interface (S I/F) 77 is adapted for receiving detection signals transmitted from the toner sensor 33, the sheet sensor 51, a sheet discharge sensor 52 and other sensors. The panel interface (P I/F) 78 is adapted for receiving a switching signal transmitted from an operation panel 1*c* as a result of mode selection between an image forming mode and a lamination mode.

Are connected to the DC controller circuit 82, a driver circuit 87 for the main motor 84, a driver circuit 88 for the sheet supply solenoid 88*a*, a driver/detection circuit 89 for the laser diode 85 and a beam detection sensor 85*a*, a driver circuit 90 for a scanner motor 86, a driver/detection circuit 91, and a high voltage board 92. The main motor 84 is adapted for driving a sheet supply side feeding mechanism such as the sheet supply roller 11, the resist roller 13, 14 and the photosensitive drum 23, and for driving the heat roller 15, the pressure roller 16 and a sheet discharge side feeding mechanism such as the discharge roller 17 and the pinch roller 18. The sheet supply solenoid 88*a* is adapted for controlling the rotation of the sheet supply roller 11 and the resist roller 13. The scanner motor 86 is adapted for driving the polygon mirror 20. The driver/detection circuit 91 is adapted for heating a heater 15*a* disposed in the heat roller 15 and for detecting a temperature of the heater. The temperature detection can be made by way of a detection of an electrical resistance of the heater 15*a*. The high voltage board 92 is adapted for generating high voltage in the photosensitive drum 23, the transfer roller 25, the charger 26 the developing roller 27 and the cleaning roller 30 and for lighting the discharge lamp 30*a*.

The ROM 72 stores therein various control program for image forming operation in the laser printer in case of the image forming mode, control program for heat-sealing the lamination member to produce a lamination product in the lamination mode, and a memory managing program for managing capacity and leading address of the data receiving buffer and a printing image memory, the data receiving buffer being provided in the RAM 73. The ROM 72 is also provided with a font memory storing therein printing dot pattern data with respect to various characters and marks.

Figure 4:
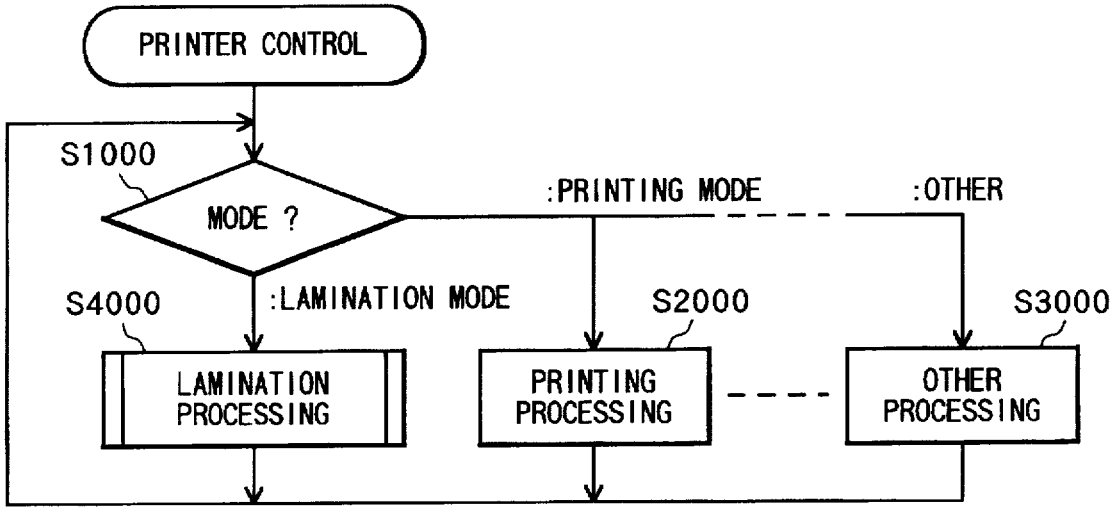
FIG. 4 is a flowchart showing a printer control executed in the control unit.

Next, a printer control routine executed by the control unit 70 will be described with reference to flowcharts shown in FIGS. 4 through 6. Upon start of the printer control routine as a result of turning ON an electrical power supply, setting mode in the operation panel 1*c* is judged (S1000). The mode setting is made by operating the panel switch 1*e* of the operation panel 1*c*.

If the image forming mode (printing mode) which is a default mode has been set, printing processing will be executed (S2000) upon receipt of the printing data from the external data transmission device PC. This printing processing (S2000) will be described in detail with reference to a flowchart shown in FIG. 5 and a timing chart shown in FIG. 7.

At a time t0, the main motor 84 is rotated at a printing rotation speed (S2010), and temperature of the heater 15*a* for fixing operation is set at a printing temperature, for example, 160° C. (S2020). Then, at a time t1, the sheet supply solenoid 88*a* is rendered ON for 0.2 seconds (S2030). Thus, the sheet supply roller 11 is rotated by 360° for about 3 seconds by way of the driving unit 6, and as a result, an uppermost sheet P of the sheet stack accommodated in the feeder case 5*a* is separated from the remaining sheet stack by the sheet supply roller 11 and the separation pad 12, and the sheet P is fed to the pair of upper and lower resist rollers 13, 14.

Then sheet detection by the sheet sensor 51 is waited (S2040), and if the sheet P is detected at a time t2 (S2040: Yes), the sheet supply solenoid 88*a* is rendered ON for 0.35 seconds (S2050) at a time t3 at which the leading edge of the sheet P is about to reach the resist rollers 13, 14. By the actuation of the sheet supply solenoid 88*a*, the rotation of the resist rollers 13, 14 are temporarily stopped for 0.35 seconds. Because of the temporary stop of the rotation of the resist rollers 13, 14, the leading edge of the sheet P abuts the resist rollers 13, 14 so that the sheet P is flexed, whereby diagonal feeding or skew of the sheet P can be corrected.

Then, printing is performed (S2060). In the printing operation, the sheet P is fed to the process unit 3 by the resist rollers 13, 14, whose rotation is re-started after stoppage of 0.35 seconds. In the process unit 3, the toner image is formed on the surface of the sheet P, and the toner image is fixed by the heat roller 15 and the pressure roller 16 in the fixing unit 4. The image carrying sheet P is then discharged onto the discharge tray 8 by the discharge roller 17 and the pinch roller 18.

Then judgment is made as to whether or not the printing operation is finished (S2080). If printing data still exist, the determination falls No, so that the routine goes back to the step S2030. That is, again the sheet supply solenoid 88*a* is rendered ON for 0.2 seconds at a time t6 (S2030), so that the second sheet P is supplied from the sheet stack, and if the sheet is detected by the sheet sensor 51 at a time t8 (S2040:Yes), the sheet supply solenoid 88*a* is rendered ON for 0.35 seconds (S2050), so that skew of the second sheet P is corrected and thereafter, the printing is performed (S2060).

If no printing data remain (S2080: Yes), sheet discharge is detected by the detection of the trailing edge of the sheet by the discharge sensor 52, this detection belonging to a different processing (not shown) executed by the control unit 70. Upon detection of the trailing edge, completion of the sheet discharge is affirmed (S2085: Yes), and the temperature of the heater 15*a* is set to a stand-by temperature such as 120° C. (S2090), and the printing processing is ended.

Incidentally, in accordance with another processing executed by the control unit 70, sheet jamming is concurrently detected based on a time period starting from the detection timing of the sheet P by the sheet supply sensor 51 and ending at the detection timing by the sheet discharge sensor 52. Further, control process for controlling the high voltage board 92 is also executed so as to form an image on the sheet P in accordance with still another processing executed by the control unit 70 as illustrated in the timing chart shown in FIG. 7.

More specifically, upon starting rotation of the main motor 84 at the time t0, the scanner motor 86 starts its rotation for driving the charger 26 and the discharge lamp 30*a*. As a result, the transfer roller 25 is applied with a reverse bias voltage whose potential is equal to that applied to the photosensitive drum 23 in order to perform cleaning to the transfer roller 25 by returning the toner affixed onto the transfer roller 25 to the photosensitive drum 23. Further, a bias voltage is also applied to the cleaning roller 30 from the timing t0 to t1 in order to transfer the toner retained on the cleaning roller 30 onto the photosensitive drum 23. The toners returned from the transfer roller 25 and the cleaning roller 30 to the photosensitive drum 23 is collected to the developing roller 27.

After the sheet is detected at the timing t2 by the sheet supply sensor 51, the reverse bias voltage applied to the transfer roller 25 is shut off at the timing t4. Instead, a forward bias is applied as the transfer bias to the transfer roller 25. That is, in order to promote toner adhesion onto the sheet P, the transfer roller 25 is imparted with a polarity opposite the photosensitive drum 23. Then, the developing roller 27 is applied with a bias voltage at a time t5 in order to adhere toner onto the photosensitive drum 23 for forming a visible toner image corresponding to the electrostatic latent image.

Thereafter, in accordance with the non detection of the sheet by the sheet supply sensor 51 at a time t7, the bias voltage applied to the developing roller 27 is shut off at a time t10, and then, in the transfer roller 25 the forward bias is rendered OFF and the reverse bias is rendered ON at a time t11. Again, in response to the second sheet detection by the sheet supply sensor 51 at a time t8, the bias voltage applied to the developing roller 27 is rendered ON at the time t11, and in the transfer roller 25 the forward bias is rendered ON and the reverse bias is rendered OFF at a time t12.

If detection of the second sheet is terminated at a time t13, then, the bias voltage applied to the developing roller 27 is rendered OFF at a time t14, and the forward bias is rendered OFF and the reverse bias is rendered ON in the transfer roller 25 at a time t15. If the sheet discharge has been completed as a result of the detection by the sheet discharge sensor 52, the scanner motor 86, the main motor 84, the charger 26 and the discharge lamp 30*a* are turned OFF, and the reverse bias applied to the transfer roller 25 is rendered OFF at a time t16.

In the step S1000, if the judgment falls a mode other than the printing mode and the lamination mode, such as a mode for outputting managing items of the printer, the managing items of the printer are printed based on the setting data in accordance with the image forming process described above (S3000).

If the operator sets the lamination mode, a lamination process (S4000) will be executed. For starting the lamination mode, the printed sheet card 106 is sandwiched between the two lamination members 102, 104 whose each one side 100 are joined together as shown in FIGS. 9(*a*) and 9(*b*). The lamination members 102, 104 retaining therein the printed card 106 are inserted into the manual insertion port 5*b* with the joined side 100 being the leading edge. Then, the lamination mode is selected by manipulating the panel switch 1*e*.

Figure 6:
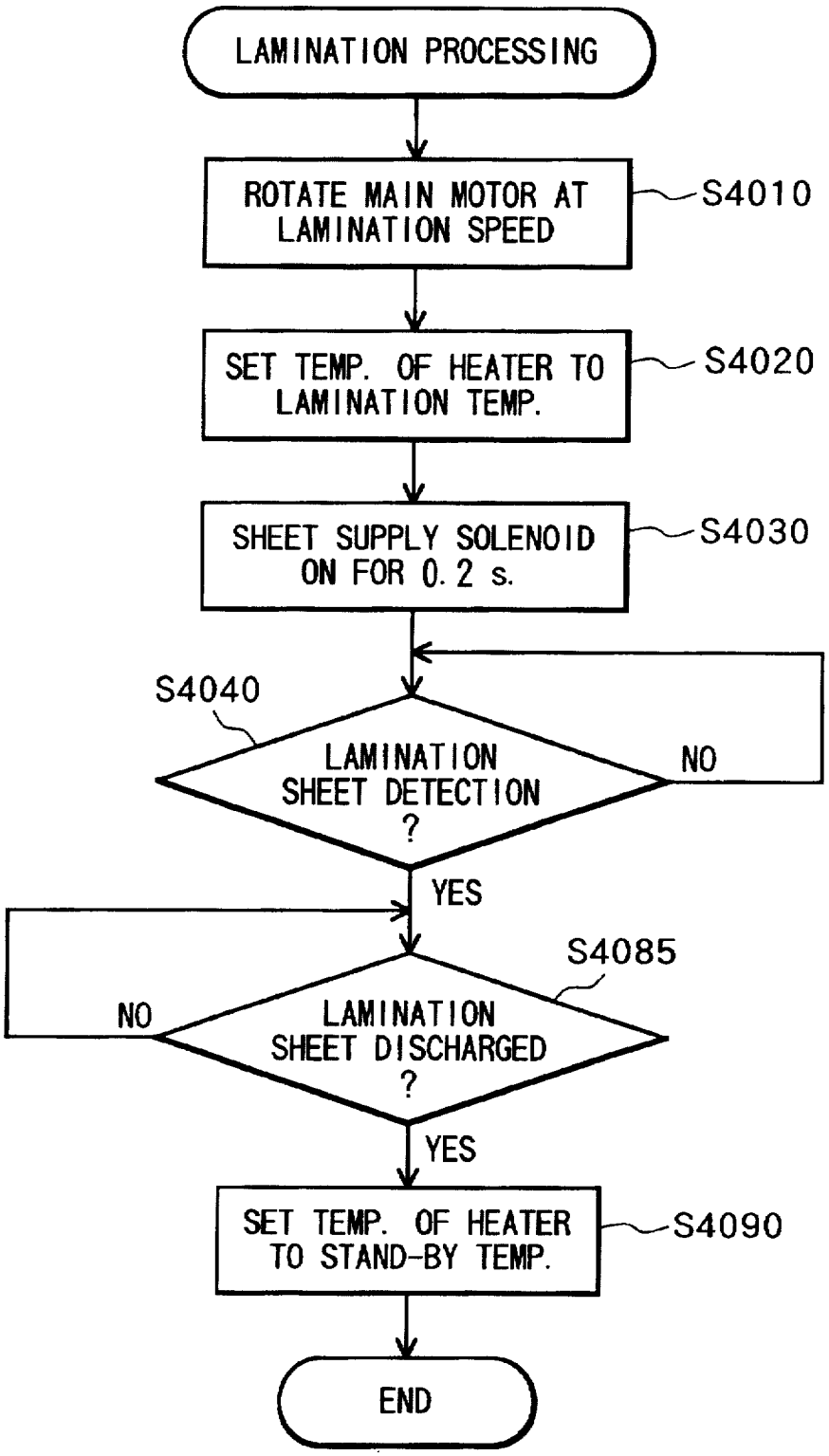
FIG. 6 is a flowchart showing a lamination processing executed in the control unit.

The lamination process is shown by a flowchart of FIG. 6. First, the main motor 84 is rotated at a lamination mode speed (S4010). This lamination mode speed is lower than the printing mode speed, for example, 1/10 of the printing mode speed in an attempt to impart great amount of heat to the lamination members 102, 104 for performing sufficient heat-sealing. Then, the temperature of the heater 15*a* is set to the lamination temperature such as 180° C. (S4020) which is higher than the printing temperature (160° C.) in an attempt to impart great amount of heat to the lamination members for performing the sufficient heat-sealing.

Figure 8:
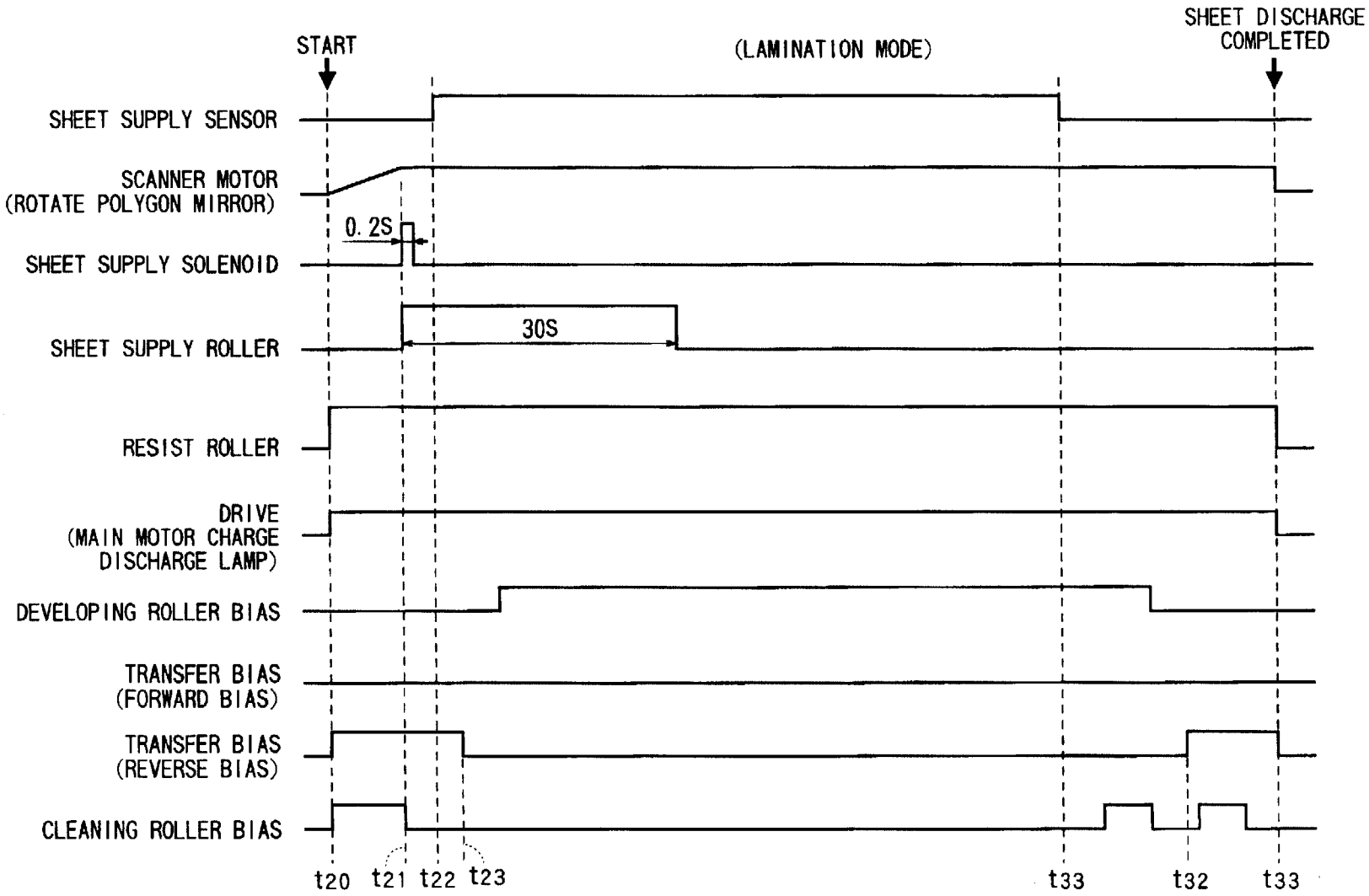
FIG. 8 is a timing chart in a lamination mode.

Then, as illustrated in a timing chart shown in FIG. 8, the sheet supply solenoid 88*a* is rendered ON for 0.2 seconds at a time t21 (S4030). As a result, the sheet supply roller 11 is rotated by 360° within 30 seconds by way of the power transmission from the driving system unit 6. Accordingly, the lamination sheet members 102, 104 retaining therein the printed sheet card 106 are fed from the manual insertion port 5*b* to the upper and lower resist rollers 13, 14 by the rotating sheet supply roller 11 and the separation pad 12.

Then, the lamination sheet detection by the sheet supply sensor 51 is waited(S4040). After the detection of the lamination sheet at a time t22 (S4040: Yes), laminating or heat-sealing operation is performed (described later), and when the discharge of the lamination product is detected (S4085), the temperature of the heater 15*a* is set to its stand-by temperature, for example at 120° C. (S4090). Thus, the lamination process is ended.

Figure 19A:
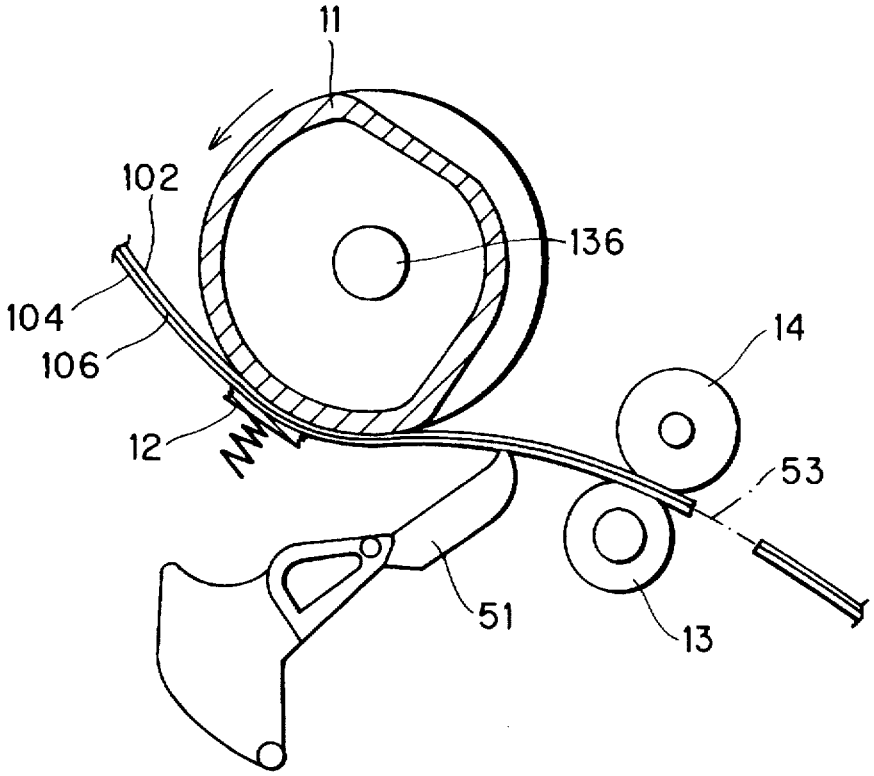
FIG. 19(*a*) is a view showing feeding fashion of the lamination sheet members in the lamination mode according to the embodiment.
Figure 19B:
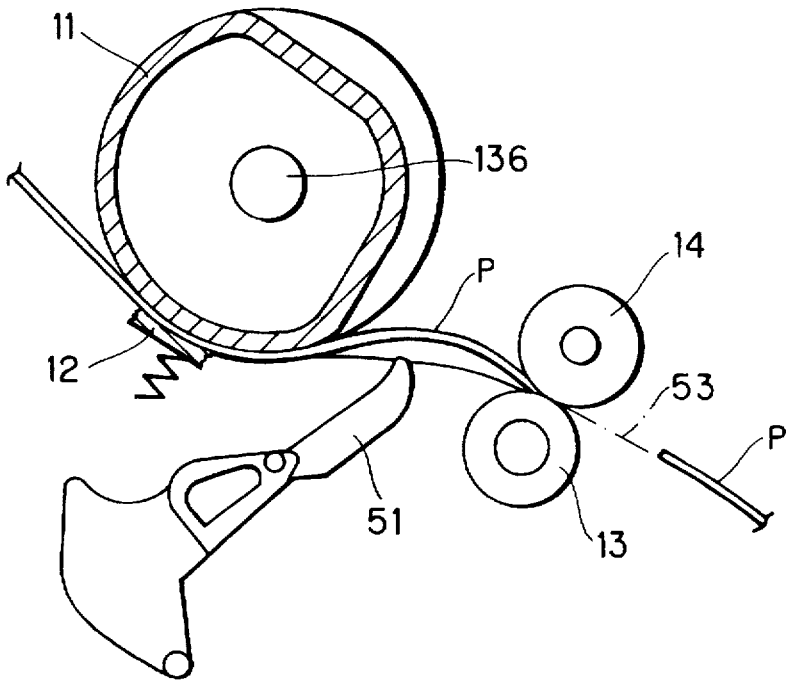

In the laminating operation, after the detection of the lamination sheets by the sheet supply sensor 51 (S4040: Yes), sheet supply solenoid 88a is not rendered ON for 3.5 seconds in contrast to the steps S2040 and S2050 attendant to the printing mode. Accordingly, the rotation of the resist rollers 13, 14 are not stopped but these rollers are continuously rotated. As a result, the lamination sheets 13, 14 retaining therein the paper card 106 are promptly fed to the process unit 3 as soon as the leading edge, i.e., fuse-bonding edge 100 reaches the resist rollers. This implies that the skew correction, which is performed in case of the printing mode by abutting the leading edge of the sheet P and flexing the sheet P, is not performed in case of the lamination mode. Consequently, as shown in FIG. 19(*a*), the lamination sheet members 102, 104 are not flexed at the passage between the sheet supply roller 11 and the resist rollers 13, 14. Because of the elimination of large bending or flex of the lamination sheets 13, 14, air trapping caused by the separation of the one lamination sheet member from the other can be avoided, and relative displacement between the lamination sheet members and generation of wrinkles is also avoidable.

During the laminating operation, contamination of the lamination sheet members 102 104 with the residual toner can be avoided by a process shown in the timing chart of FIG. 8, even though this process is not shown in the flowchart of FIG. 6. That is, in the process unit 3, if the lamination sheet members 102, 104 exist at a position between the photosensitive drum 23 and the transfer roller 25, the transfer roller 25 is not imparted with forward bias or reverse bias with respect to the photosensitive drum 23. Therefore, even if residual toner exist at the surface of the photosensitive drum 23 or the transfer roller 25, the toner are not transferred therefrom nor absorbed onto the lamination sheet members 102, 104. Accordingly, the surface of the lamination sheet members 102, 104 are not contaminated with the toner, even though the lamination sheet members are fed past the identical sheet passage in case of the printing mode.

Figure 10:
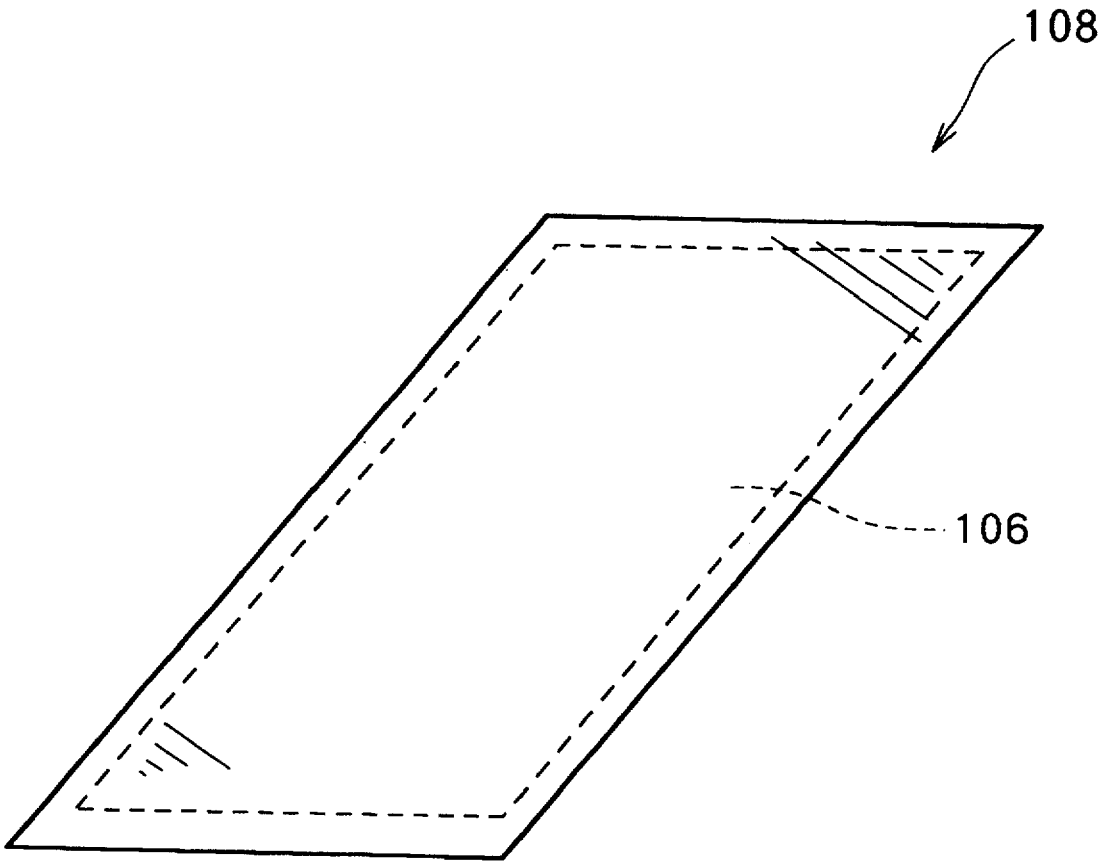
FIG. 10 is a perspective view showing a lamination product.

After the lamination sheet members 102, 104 are moved past the fixing unit 4, these members are cooled by ambient air. When the lamination sheet members 102, 104 are discharged onto the discharge tray 6 after moving past the discharge roller 17 and the pinch roller 18, side edge portions of the lamination sheet members 102, 104 are solidified and bonded together. Thus, the printed sheet card 106 is hermetically sealed by the lamination sheet member 102, 104 to provide a lamination product 108 as shown in FIG. 10 in which air involvement nor relative displacement between the lamination sheet members 102 and 104 do not occur.

Figure 7:
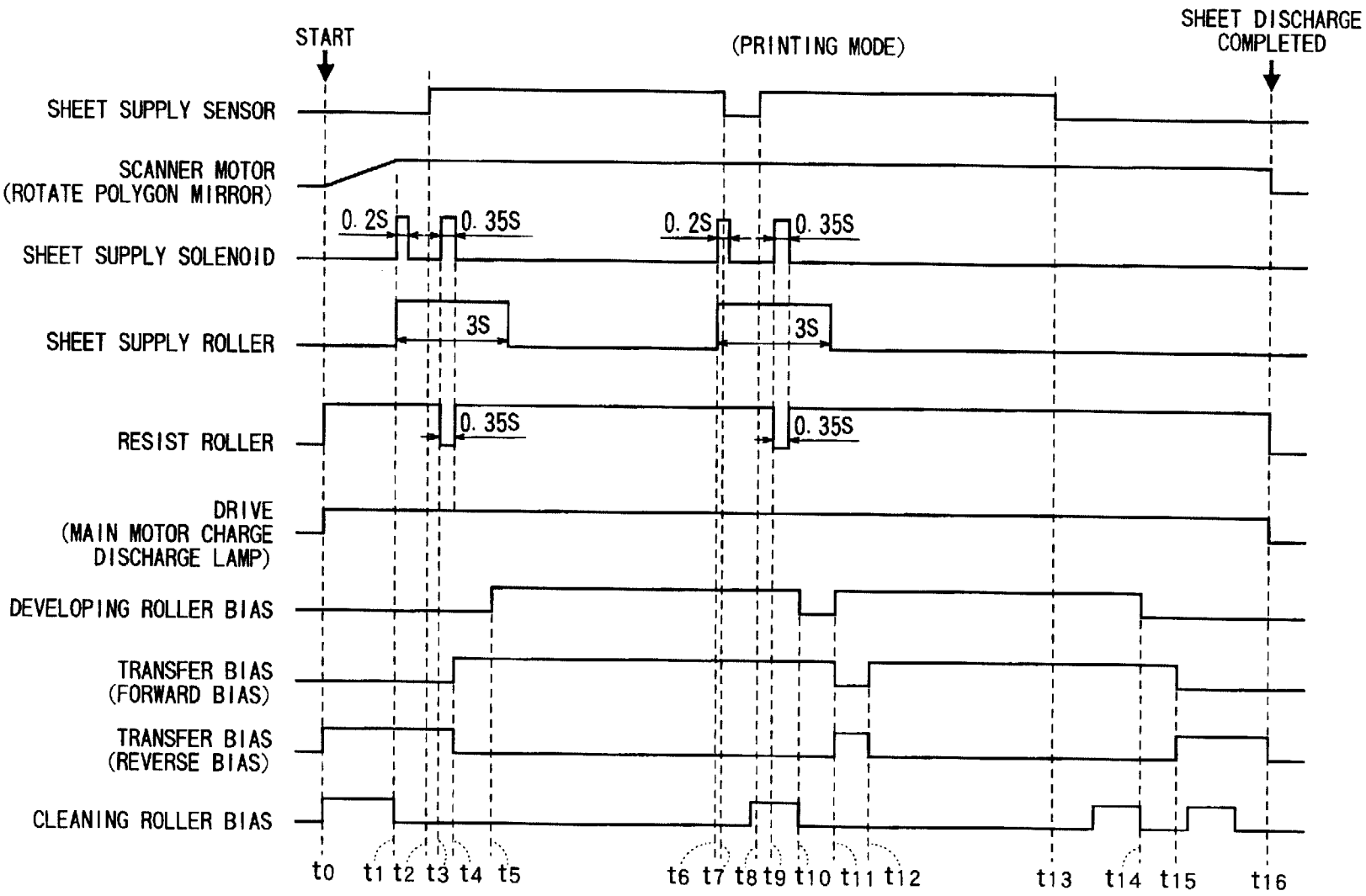
FIG. 7 is a timing chart in a printing mode.
Figure 18A:
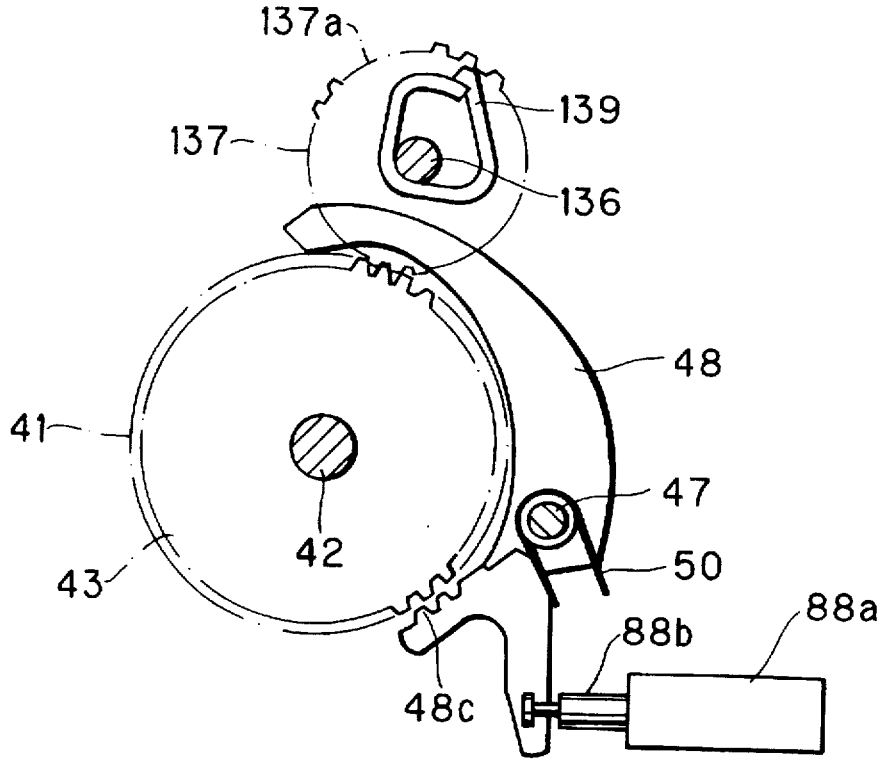
FIG. 18(*a*) and 18(*b*) are views showing postures of the first and second levers, respectively in the skew correcting operation.
Figure 18B:
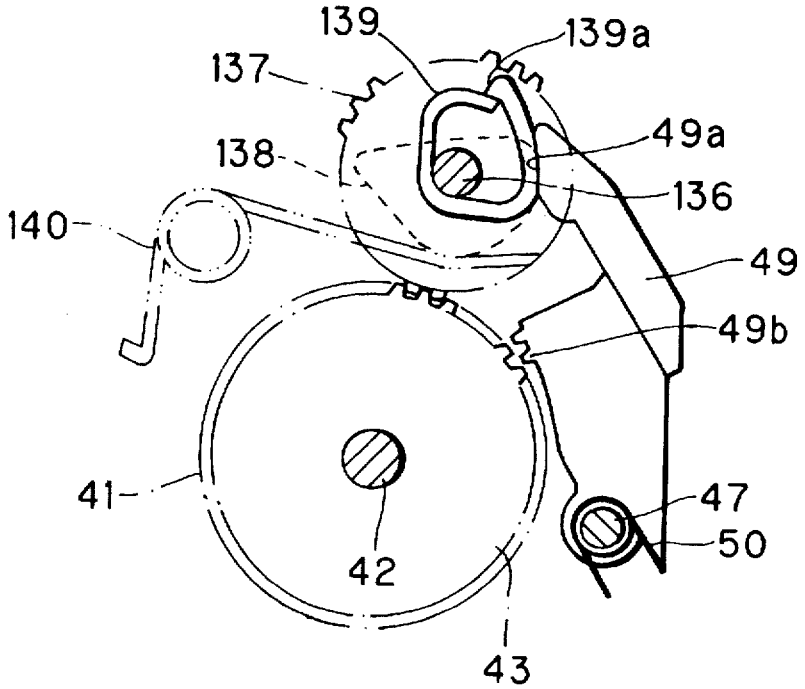

Then, description will be given with respect to the operation of the sheet supplying mechanism and the gear transmission mechanism with reference to FIGS. 15(*a*) through FIG. 18(*b*) and the timing charts shown in FIGS. 7 and 8. In the following description, assuming that the main motor 84 is continuously driven upon tuning ON the main switch so that the input gear 41 is continuously rotated.

In a sheet supply stand-by state, the first and second levers 48 and 49 provide their postures shown in FIG. 15(*a*) and 15(*b*), respectively. In this stand-by state, the non-teeth portion 137*a* is in confrontation with the input gear 41. In this case, the cam locking portion 48*a* of the first lever 48 is in locking engagement with the locking portion 139*a* of the locking cam 139, and further, the first engagement portion 48*c* of the first lever 48 is in meshing engagement with the large diameter gear portion 43*a* of the resist clutch 43. Moreover, the intermittent gear 137 is urged in the direction indicated by the arrow X in FIG. 15(*b*) because of the biasing force of the torsion spring 140 and therefore, the gear teeth portion subsequent to the non-teeth portion 137*a* is easily engageable with the input gear 41. On the other hand, the abutment portion 49*a* of the second lever 49 is in abutment with the small radius portion of the locking cam 139 because of the biasing force of the coil spring 50. In this posture of the second lever 49, the second engagement portion 49*b* of the second lever 49 is in meshing engagement with the large diameter gear portion 43*a* of the resist clutch 43. Accordingly, the resist clutch 43 is maintained in its locking state, i.e., non-rotatable state. In this instance, the rotation of the sheet supply roller 11 is stopped in such a manner that the small radius portion 11*b* of the sheet supply roller 11 is in confrontation with the separation pad 12.

Therefore, the rotation of the input gear 41 is not transmitted to the intermittent gear 37, so that the sheet supply roller 11 maintains its non-rotating state. As a result, the sheet P is not delivered from the sheet feeder unit 5. On the other hand, the rotation of the input gear 41 is transmitted to the transfer gear 45 through the planetary gears 46 so as to rotate the resist rollers 13, 14. If the sheet P is nipped between the resist rollers 13 and 14, the sheet P is fed to the process unit 3. Such a state corresponds to a timing immediately before the above described timings t1, t6 and t21 in the timing charts of FIGS. 7 and 8.

Figure 16A:
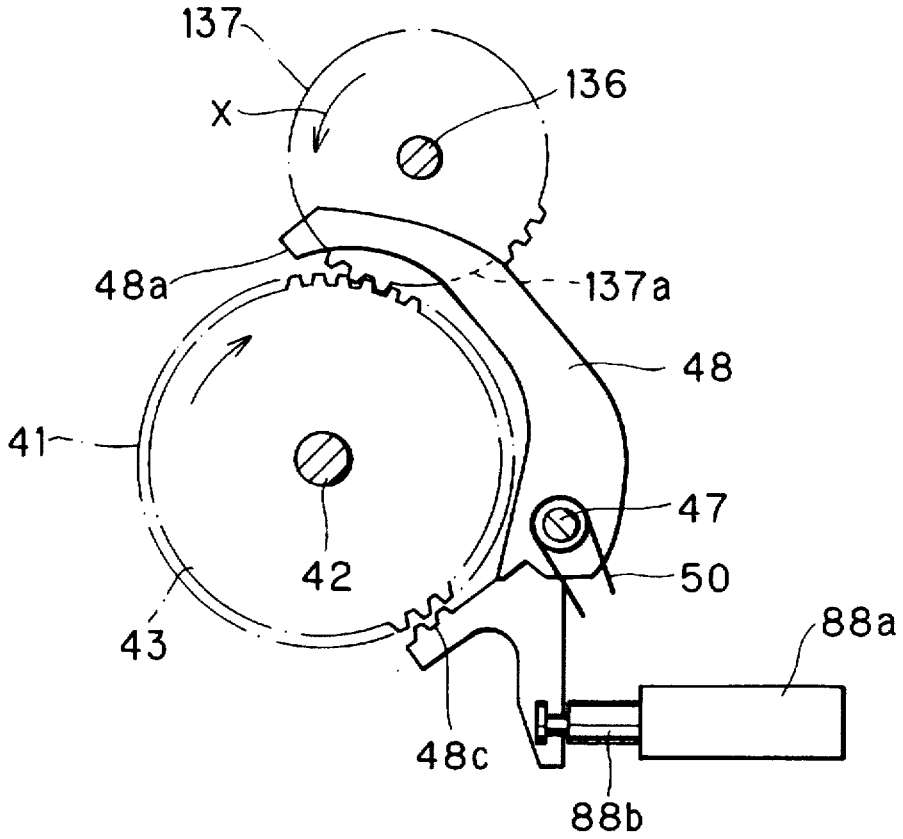
FIG. 16(*a*) and 16(*b*) are views showing postures of the first and second levers, respectively at a phase immediately after the start of the sheet supplying operation.
Figure 16B:
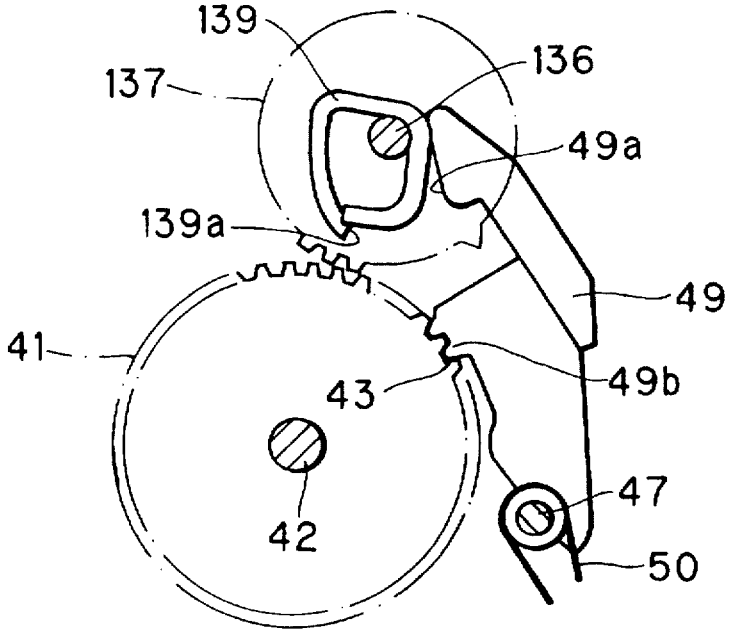

Then, in response to a sheet supplying command, the sheet supplying mechanism will be driven for supplying the sheet P, and the starting phase is shown in FIGS. 16(*a*), 16(*b*), and FIG. 11.

At the timings t1, t6 and t21, the sheet supply solenoid 88*a* is rendered ON for 0.2 seconds as described above. Upon energization of the solenoid 88*a*, the plunger 88*b* is retracted, so that the first lever 48 is pivotally moved in the counterclockwise direction in FIG. 16(*a*). Thus, the cam locking portion 48*a* of the first lever 48 is disengaged from the locking portion 139*a* of the locking cam 139. As a result the intermittent gear 137 is rotated in the direction X by the biasing force of the torsion spring 140, and consequently, the teethed portion of the intermittent gear 137 is brought into meshing engagement with the input gear 41. By the rotation of the intermittent gear 137, the sheet supply roller 11 is rotated in a direction indicated by an arrow X in FIG. 11 with the arcuate portion 11*a* being in contact with the uppermost sheet P. The sheet supply solenoid 88*a* is deenergized within one rotation of the sheet supply roller 11, so that the plunger 88*b* is extended to pivotally move the first lever 48, and as a result, the cam locking portion 48*a* is brought into engagement with the locking portion 139*a*. Thus, rotation of the sheet supply roller 11 is stopped.

During ON state of the sheet supply solenoid 88*a* within the short period (0.2 seconds), the first engagement portion 48*b* is disengaged from the large diameter gear portion 43*a*. However, as shown in FIG. 16(*b*), the second engagement portion 49*b* is still engaged with the large diameter gear portion 43*a*. Accordingly, the lock state of the resist clutch 43 is maintained. Thus, by the rotation of the input gear 41, the planetary gears 46 are rotated to continuously rotate the transfer gear 45, thereby rotating the resist roller 13. If the sheet supply solenoid 88*a* is deenergized, the first engagement portion 48*a* is again brought into engagement with the large diameter gear portion 4*a* of the resist clutch 43.

Figure 5:
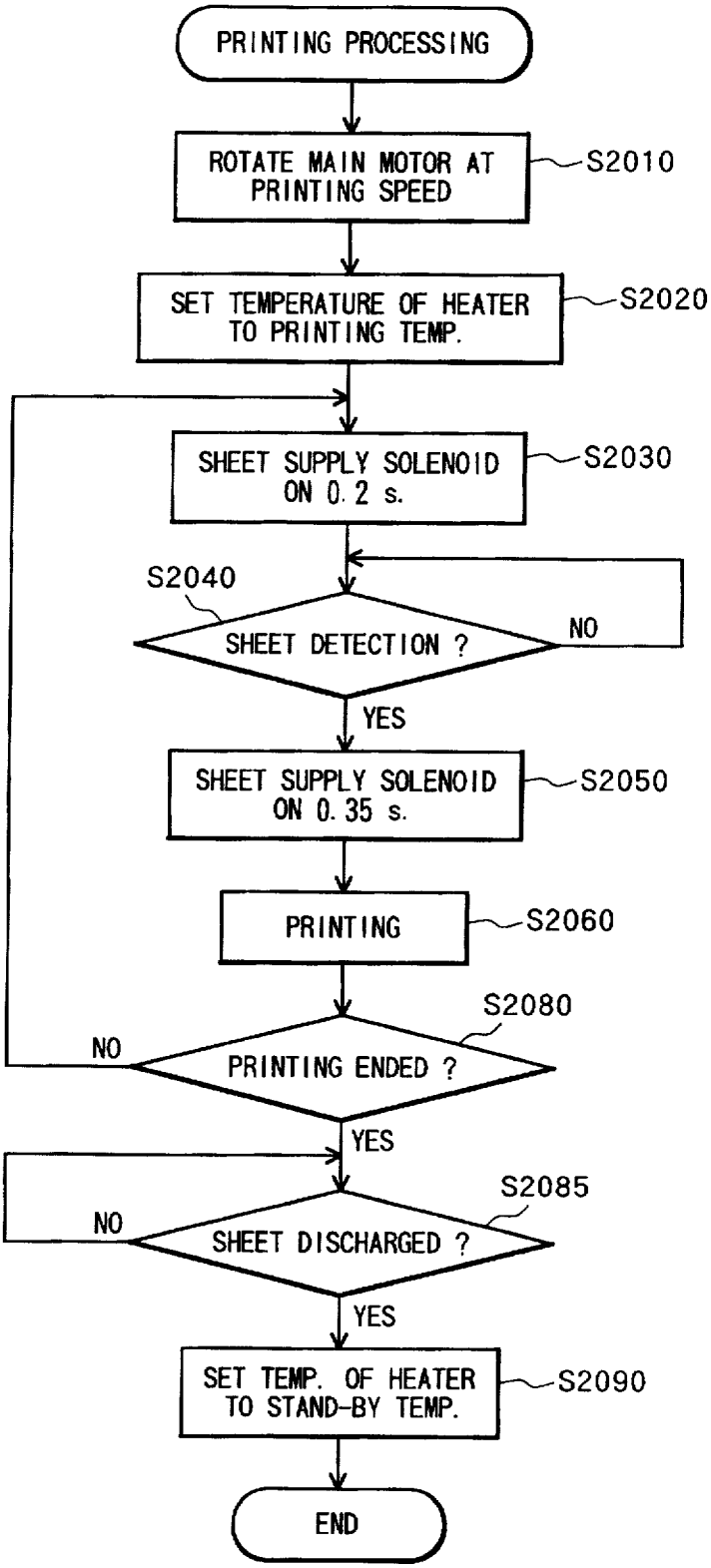
FIG. 5 is a flowchart showing a print processing executed in the control unit.

Regarding the skew correction performed by the step S2050 shown in FIG. 5, at a timing immediately before the timings t3 and t9, the first and second levers 48 and 49 have their postures shown in FIGS. 17(*a*) and (*b*), respectively. Further, during actual skew correction period of 0.35 seconds starting from the timings t3 or t9, the first and second levers 48,49 have their postures shown in FIGS. 18(*a*) and 18(*b*).

If the leading edge of the sheet P is detected by the sheet supply sensor 51, the sheet supply solenoid 88*a* is rendered ON for short period, for example, from 0.2 to 0.5 seconds, such as 0.35 seconds immediately before the leading edge of the sheet P reaches the resist rollers 13, 14. Upon turning ON the solenoid 88*a* , the first engagement portion 48*c* is disengaged from the large diameter gear portion 43*a* of the resist clutch 43 for a short period as understood from the state shown in FIG. 17(*a*) to the state in FIG. 18(*a*).

In this instance, the large radius portion of the locking cam 139 rotated integrally with the intermittent gear 137 pushes the abutment portion 49*a* of the second lever 49. Therefore, the second engagement portion 49*b* is also disengaged from the large diameter gear portion 43*a* as understood from the state shown in FIG. 17(*b*) to the state in FIG. 18(*b*).

Accordingly, the resist clutch 43 can be freely rotated, and therefore, the rotation of the transfer gear 45 and the intermediate gear 44 are stopped, and consequently, the rotation of the resist rollers 13, 14 is stopped. With this state, the leading edge of the sheet P abuts the surface of the resist rollers 13, 14 and the sheet P is bent or flexed as shown in FIG. 19(*b*). Thus, the leading edge of the sheet can be oriented in a direction in parallel with the axial direction of the resist rollers 13, 14, i.e., skew correction can be performed.

Immediately after elapsing 0.35 seconds, the sheet supply solenoid 88*a* is deenergized, so that the first engagement portion 48*c* is brought into engagement with the large diameter gear portion 43*a* for locking the resist clutch 43. Accordingly, the transfer gear 45 starts rotating for rotating the resist rollers 13, 14, so that the leading edge of the sheet P is nipped between the resist rollers 13 and 14, and the sheet P is fed in the sheet feeding direction.

At the initial rotating phase of the sheet supply roller 11, the abutment portion 49*a* of the second lever 49 is still pushed by the large radius portion of the locking cam 139. Therefore, the second engagement portion 49*b* is still disengaged from the large diameter gear portion 43*a* as shown in FIG. 18(*b*). However, if the intermittent gear 137 is rotated to its initial rotating position, the small radius portion of the locking cam 139 is brought into confrontation with the abutment portion 49*a* of the second lever 49. Consequently, the second engagement portion 49*b* can be engaged with the large diameter gear portion 43*a* as shown in FIG. 15(*b*).

As described above, the skew correction is not performed during the lamination mode. Therefore as shown in FIG. 8, the resist rollers 13, 14 are continuously rotated upon turning ON the main switch, and as shown in FIG. 19(*a*), the lamination sheet members 102, 104 are fed toward the process unit 3 without intermittent stoppage in front of the resist rollers. Thus, no flex occur in the lamination sheet members and, air trapping, floating of one lamination sheet member from the other, generation of wrinkles, and relative displacement between the superposing lamination sheet members can be eliminated. In case of the lamination mode, the skew correction is unnecessary because image forming operation on the lamination sheet member is not required. In other words, diagonal feeding of the lamination sheet members does not cause any problem.

While the invention has been described in detail and with reference to the specific embodiments thereof, it would be apparent to those skilled in the art that various changes and modifications may be made therein without departing from the spirit and scope of the invention. For example, in the depicted embodiment, rotation speed of the main motor 84 in the lamination mode is lower than that in the printing mode, and at the same time, the temperature of the heater 15*a* in the lamination mode is higher than that in the printing mode in order to impart sufficient heat on the lamination sheet members. However, either the speed reduction or temperature rise is available as far as the lamination sheet members can receive sufficient heat.

Further, in the illustrated embodiment, the skew correction is performed by intermittently stopping rotation of the resist rollers 13, 14. However, instead of the intermittent stop of the resist rollers, other mechanism is conceivable.

For example, a stop member can be movably provided toward and away from the sheet feed passage so as to selectively block the sheet feed passage.

Furthermore, in the above described embodiment, the image forming device having the laminating function is applied to the laser printer. However, a facsimile machine and a copying machine are also available for incorporating therein the laminating function.

What is claimed is:

1. An image forming device for forming a visible image on an image recording medium running in a sheet feed passage, the image recording medium having a leading edge in a sheet feeding direction, the device comprising:

a skew correcting portion disposed along the sheet feed passage for aligning the leading edge with a predetermined orientation;

an image forming portion disposed along the sheet feed passage and downstream of the skew correcting portion in the sheet feeding direction for forming the visible image on the image recording medium;

a fixing portion disposed along the sheet feed passage and downstream of the image forming portion, the fixing portion heating the image recording medium for fixing the visible image on the image recording medium;

mode setting means for selectively setting one of a printing mode for printing the visible image on the image recording medium and a lamination mode for heat-sealing a pair of lamination sheet members interposing therebetween a sheet to be laminated to produce a lamination sheet at the fixing portion; and a control unit connected to the mode setting means, the skew correcting portion, the image forming portion and the fixing portion for activating the skew correcting portion, the image forming portion and the fixing portion in response to a selection of the printing mode by the mode setting means, and for deactivating the skew correcting portion and the image forming portion while activating the fixing portion in response to a selection of the lamination mode by the mode setting means, in the lamination mode, the pair of lamination sheet members and the sheet to be laminated interposed therebetween are fed along the sheet feed passage and move past the skew correcting portion, the image forming portion, and the fixing portion.

2. The image forming device as claimed in claim 1, wherein the skew correcting portion comprises a skew correcting surface abuttable on the leading edge of the image recording medium in the printing mode, feeding of the leading edge in the sheet feeding direction being temporarily prevented by the skew correcting surface for aligning the leading edge with the aligning surface.

3. The image forming device as claimed in claim 2, wherein the skew correcting portion comprises a pair of rollers in confronting relation with each other so as to nip the image recording medium in case of the printing mode and the pair of lamination sheet members in case of the lamination mode, the skew correcting surface being provided by at least one of the peripheral surfaces of the pair of rollers.

4. The image forming device as claimed in claim 3, wherein the control unit temporarily stops rotation of the rollers for activating the skew correcting surface in case of the printing mode, and permits the rollers to be continuously rotated for deactivating the skew correcting surface in case of the lamination mode.

5. The image forming device as claimed in claim 1, wherein the control unit provides a first feeding speed of the image recording medium in the sheet feed passage in case of the printing mode, and provides a second feeding speed of the pair of lamination sheet members in the sheet feed passage in case of the lamination mode, the second speed being lower than the first speed.

6. The image forming device as claimed in claim 5, wherein the control unit provides a fixing temperature at the fixing portion in the printing mode, and provides a lamination temperature at the fixing portion in the lamination mode, the lamination temperature being higher than the fixing temperature.

7. The image forming device as claimed in claim 1, wherein the control unit provides a fixing temperature at the fixing portion in the printing mode, and provides a lamination temperature at the fixing portion in the lamination mode, the lamination temperature being higher than the fixing temperature.

8. The image forming device as claimed in claim 7, wherein the fixing portion comprises a heat roller and a pressure roller in nipping contact with the heat roller, the sheet feed passage passing between the heat roller and the pressure roller, the heat roller housing therein a heating element connected to the control unit.

9. The image forming device as claimed in claim 1, wherein the image recording medium comprises a cut sheet, and the device further comprising a sheet supplying mechanism for supplying each one of the cut sheet into the sheet feed passage and at a position upstream of the skew correcting portion.

10. The image forming device as claimed in claim 9, further comprising a manual insertion portion for inserting the pair of lamination sheet members interposing therebetween the sheet to be laminated into the sheet feed passage, the manual insertion portion being positioned adjacent the sheet supplying mechanism.

11. The image forming device as claimed in claim 9, wherein the sheet supplying mechanism comprises a sheet supply roller in direct contact with the cut sheet, the control unit controlling rotation of the sheet supply roller for feeding the cut sheet in the sheet feeding direction, and wherein the skew correcting portion comprises a skew correcting surface abuttable on the leading edge of the image recording medium in the printing mode, feeding of the leading edge in the sheet feeding direction by the sheet supply roller being temporarily prevented by the skew correcting surface for aligning the leading edge with the aligning surface.

12. The image forming device as claimed in claim 11, wherein the sheet supplying mechanism further comprises:

an intermittent gear mounted coaxially with the sheet supply roller for rotating the sheet supply roller;

an input gear in meshing engagement with the intermittent gear for rotating the intermittent gear; and a drive gear in meshing engagement with the input gear for rotating the input gear.

13. The image forming device as claimed in claim 12, further comprising a mechanism for intermittently rotating the pair or rollers, the intermittently rotating mechanism comprising:

a locking cam provided coaxially and integrally with the intermittent gear, the locking cam having a locking portion;

a support shaft;

a resist clutch rotatable about the support shaft and comprising a large diameter gear portion and a small diameter gear portion, the input gear being rotatably supported on the small diameter portion;

a plurality of planetary gears rotatably supported on the input gear and meshedly engaged with the small diameter gear portion;

a transfer gear rotatably supported on the support shaft and meshedly engaged with the planetary gears, the transfer gear being only rotatable about the support shaft when the rotation of the large diameter gear portion is locked, and the rotation of the transfer gear being transmitted to the pair of rollers;

an actuator selectively providing a retracted position and extending position;

a second shaft;

a first lever pivotally supported on the second shaft and connected to the actuator, the first lever having a free end engageable with the locking portion when the actuator has the extending position, the first lever having a first engagement portion engageable with the large diameter gear portion when the actuator has the extending position for locking the large diameter gear portion; and a second lever pivotally supported on the second shaft and having an abutment portion in contact with the locking cam, the second lever having a second engagement portion engageable with the large diameter gear portion.

14. The image forming device as claimed in claim 13, wherein the intermittent gear has a non-teeth portion confrontable with the input gear when the free end of the first lever is in locking engagement with the locking portion of the locking cam for preventing the intermittent gear from being rotated.

15. The image forming device as claimed in claim 13, wherein the locking cam has a small radius portion and a large radius portion, the second engagement portion being in meshing engagement with the large diameter gear portion when the abutment portion of the second lever is in contact with the small radius portion and the second engagement portion being disengaged from the large diameter gear portion when the abutment portion is in contact with the large radius portion.

16. The image forming device as claimed in claim 15, wherein the intermittently rotating mechanism further comprises:

a spring receiving cam provided coaxially and integrally with the intermittent gear; and a spring in contact with the spring receiving cam for urging the intermittent gear in one rotating direction.

17. The image forming device as claimed in claim 3, wherein the pair of rollers comprise a pair of resist rollers including an upper resist roller positioned immediately above the sheet feed passage and a lower resist roller positioned immediately below the sheet feed passage.

18. The image forming device as claimed in claim 1, wherein the image forming portion comprises a developing portion having a photosensitive drum and a transfer roller, an electrostatic latent image being formed on the photosensitive drum in accordance with an imaging information for forming a toner image corresponding to the electrostatic latent image, the transfer roller being in confrontation with the photosensitive drum for transferring the toner image onto the image recording medium, the sheet feed passage passing between the photosensitive drum and the transfer roller.

19. The image forming device as claimed in claim 18, further comprising a transfer bias application unit connected to the transfer roller for applying a transfer bias to the transfer roller so that polarities of the photosensitive drum and the transfer roller are opposite to each other for electrostatically moving the toner image on the photosensitive drum to the image recording medium.

20. The image recording device as claimed in claim 19, wherein the control unit is connected to the transfer bias application unit so that the transfer bias is applied to the transfer roller in response to selection of the printing mode and the application of the transfer bias to the transfer roller is prohibited in response to selection of the lamination mode.

21. The image forming device according to claim 10, wherein the sheet supplying mechanism comprises a sheet supply roller in direct contact with one of the cut sheet or the pair of lamination sheet members and positioned upstream of the skew connecting portion, and wherein the sheet feed passage passing through the sheet supply roller, the skew correcting portion, the image forming portion, and the fixing portion extends substantially linearly.

* * * * *